US011649531B2

(12) United States Patent
Sano et al.

(10) Patent No.: US 11,649,531 B2
(45) **Date of Patent: *May 16, 2023**

(54) STEEL SHEET AND PLATED STEEL SHEET

(71) Applicant: NIPPON STEEL & SUMITOMO METAL CORPORATION, Tokyo (JP)

(72) Inventors: Kohichi Sano, Tokyo (JP); Makoto Uno, Tokyo (JP); Ryoichi Nishiyama, Tokyo (JP); Yuji Yamaguchi, Tokyo (JP); Natsuko Sugiura, Tokyo (JP); Masahiro Nakata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 393 days.

This patent is subject to a terminal disclaimer.

(21) Appl. No.: 16/314,945

(22) PCT Filed: Aug. 4, 2017

(86) PCT No.: PCT/JP2017/028472

§ 371 (c)(1),
(2) Date: Jan. 3, 2019

(87) PCT Pub. No.: WO2018/026013

PCT Pub. Date: Feb. 8, 2018

(65) Prior Publication Data

US 2019/0309398 A1 Oct. 10, 2019

(30) Foreign Application Priority Data

Aug. 5, 2016 (JP) ..... JP2016-155101

(51) Int. Cl.
*C22C 38/04* (2006.01)
*C22C 38/00* (2006.01)
(Continued)

(52) U.S. Cl.
CPC ..... *C22C 38/04* (2013.01); *C22C 38/00* (2013.01); *C22C 38/001* (2013.01); *C22C 38/06* (2013.01);
(Continued)

(58) Field of Classification Search
CPC ..... C22C 38/02; C22C 38/04; C22C 38/06; C22C 38/12; C22C 38/14; C22C 38/00–60; C21D 9/46; C21D 9/48
See application file for complete search history.

(56) References Cited

U.S. PATENT DOCUMENTS 10,689,737 B2 * 6/2020 Wakita ..... C22C 38/58
10,889,879 B2 * 1/2021 Sano ..... C22C 38/001
(Continued)

FOREIGN PATENT DOCUMENTS

CA 2 944 863 A1 10/2015
CN 105102658 A 11/2015
(Continued)

OTHER PUBLICATIONS

International Preliminary Report on Patentability and English translation of the Written Opinion of the International Searching Authority (Forms PCT/IB/338, PCT/IB/373, and PCT/ISA/237) for International Application No. PCT/JP2017/028472, dated Feb. 14, 2019.
(Continued)

*Primary Examiner* — Keith Walker
*Assistant Examiner* — Benjamin C Anderson
(74) *Attorney, Agent, or Firm* — Birch, Stewart, Kolasch & Birch, LLP

(57) ABSTRACT

A steel sheet has a specific chemical composition and has a structure represented by, by area ratio, ferrite: 5 to 60%, and bainite: 40 to 95%. When a region that is surrounded by a grain boundary having a misorientation of 15° or more and has a circle-equivalent diameter of 0.3 μm or more is defined
(Continued)

as a crystal grain, the proportion of crystal grains each having an intragranular misorientation of 5 to 14° to all crystal grains is 20 to 100% by area ratio. A precipitate density of Ti(C,N) and Nb(C,N) each having a circle-equivalent diameter of 10 nm or less is $10^{10}$ precipitates/$mm^3$ or more. A ratio (Hvs/Hvc) of a hardness at 20 μm in depth from a surface (Hvs) to a hardness of the center of a sheet thickness (Hvc) is 0.85 or more.

9 Claims, 1 Drawing Sheet

(51) Int. Cl.

| | |
|---|---|
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 2/40*** | (2006.01) |
| *C22C 49/11* | (2006.01) |
| *C21D 9/46* | (2006.01) |

(52) U.S. Cl.

CPC ..... *C22C 38/08* (2013.01); *C22C 38/12* (2013.01); *C22C 38/14* (2013.01); *C22C 38/32* (2013.01); *C22C 38/34* (2013.01); *C22C 38/38* (2013.01); *C22C 38/42* (2013.01); *C22C 38/48* (2013.01); *C22C 38/50* (2013.01); *C22C 38/54* (2013.01); *C22C 38/58* (2013.01); *C23C 2/405* (2013.01); *C21D 9/46* (2013.01); *C21D 2211/002* (2013.01); *C21D 2211/005* (2013.01); *C22C 49/11* (2013.01); *C22C 2200/02* (2013.01); *C22C 2204/00* (2013.01)

(56) References Cited

U.S. PATENT DOCUMENTS

| | | | | |
|---|---|---|---|---|
| 10,913,988 | B2 * | 2/2021 | Shuto | C22C 38/50 |
| 2010/0047617 | A1 | 2/2010 | Sugiura et al. | |
| 2010/0319819 | A1 | 12/2010 | Kaneko | |
| 2012/0031528 | A1 * | 2/2012 | Hayashi | C22C 38/12 148/269 |
| 2014/0014237 | A1 | 1/2014 | Yokoi et al. | |
| 2014/0110022 | A1 * | 4/2014 | Sano | C22C 38/04 148/333 |
| 2014/0311631 | A1 | 10/2014 | Hayashi et al. | |
| 2015/0044502 | A1 * | 2/2015 | Nakaya | A47J 27/00 428/659 |
| 2015/0071812 | A1 | 3/2015 | Kawano et al. | |
| 2015/0101717 | A1 | 4/2015 | Kosaka et al. | |
| 2016/0017465 | A1 * | 1/2016 | Toda | C22C 38/001 420/83 |
| 2016/0068937 | A1 * | 3/2016 | Nakajima | C23C 2/02 428/659 |
| 2017/0211164 | A1 * | 7/2017 | Kimura | C21D 8/0278 |
| 2017/0349967 | A1 * | 12/2017 | Yokoi | C22C 38/002 |
| 2019/0226061 | A1 * | 7/2019 | Sano | C22C 38/12 |
| 2019/0241996 | A1 * | 8/2019 | Sano | C22C 38/28 |

FOREIGN PATENT DOCUMENTS

| | | | | |
|---|---|---|---|---|
| EP | 1 350 859 | A1 | 10/2003 | |
| EP | 2 453 032 | A1 | 5/2012 | |
| EP | 2 599 887 | A1 | 6/2013 | |
| EP | 2 631 314 | A1 | 8/2013 | |
| EP | 2 865 778 | A1 | 4/2015 | |
| JP | 2005-256115 | A | 9/2005 | |
| JP | 2007-247046 | A | 9/2007 | |
| JP | 2009-19265 | A | 1/2009 | |
| JP | 2009-191360 | A | 8/2009 | |
| JP | 2011-140671 | A | 7/2011 | |
| JP | 2013-209723 | A | 10/2013 | |
| JP | 2014-37595 | A | 2/2014 | |
| JP | 5445720 | B1 | 3/2014 | |
| JP | 2015-124411 | A | 7/2015 | |
| JP | 2016-50334 | A | 4/2016 | |
| KR | 10-2013-0133046 | A | 12/2013 | |
| WO | WO 2008/056812 | A1 | 5/2008 | |
| WO | WO 2010/137317 | A1 | 12/2010 | |
| WO | WO 2013/161090 | A1 | 10/2013 | |
| WO | WO 2014/014120 | A1 | 1/2014 | |
| WO | WO-2014171427 | A1 * | 10/2014 | C22C 38/28 |
| WO | WO-2016013145 | A1 * | 1/2016 | B21B 1/22 |

OTHER PUBLICATIONS

Extended European Search Report dated Nov. 27, 2019, for corresponding European Patent Application No. 17837114.2.

Chinese Office Action and Search Report dated Apr. 21, 2020, for corresponding Chinese Patent Application No. 201780046243.0, with translation of the Office Action.

International Search Report for PCT/JP2017/028472 dated Oct. 31, 2017.

Written Opinion of the International Searching Authority for PCT/JP2017/028472 (PCT/ISA/237) dated Oct. 31, 2017.

* cited by examiner

STEEL SHEET AND PLATED STEEL SHEET

TECHNICAL FIELD

The present invention relates to a steel sheet and a plated steel sheet.

BACKGROUND ART

Recently, the reduction in weight of various members aiming at the improvement of fuel efficiency of automobiles has been demanded. Therefore, the application of light metal such as an Al alloy is limited to special uses in response to this demand. Thus, thinning achieved by an increase in strength of a steel sheet has been demanded in order to apply the reduction in weight of various members to a more inexpensive and broader range.

When the steel sheet is increased in strength, material properties such as formability (workability) deteriorate generally. Therefore, in the development of a high-strength steel sheet, achieving the increase in strength without deterioration in the material properties is an important task.

For example, after blanking or hole making is performed by shearing or punching, press forming based on stretch-flanging and burring mainly is performed, and good stretch flangeability is demanded.

Further, it is effective to increase a yield stress of a steel product in order to increase collision energy absorptivity to work when automobile collision occurs. This is because it is possible to absorb the energy efficiently with a small amount of deformation.

Further, on the other hand, if a fatigue property deteriorates greatly even after the steel sheet is increased in strength, it is impossible to use the steel sheet as an automotive steel sheet.

Further, steel sheets used for underbody members are likely to be exposed to rainwater, and when they are reduced in thickness, the thickness reduction caused by corrosion becomes a major issue, and thus corrosion resistance is also demanded.

In response to the above-described task of good stretch flangeability, for example, Patent Reference 1 discloses that the size of TiC is limited, thereby making it possible to provide a steel sheet excellent in ductility, stretch flangeability, and material uniformity. Further, Patent Reference 2 discloses that types, sizes, and number densities of oxides are defined, thereby making it possible to provide a steel sheet excellent in stretch flangeability and fatigue property. Further, Patent Reference 3 discloses that an area ratio of a ferrite phase and a hardness difference with a second phase are defined, thereby making it possible to provide a steel sheet having reduced strength variation and having excellent ductility and hole expandability.

However, in the above-described technique disclosed in Patent Reference 1, it is necessary to secure 95% or more of the ferrite phase in the structure of the steel sheet. Therefore, in order to secure a sufficient strength, 0.08% or more of Ti needs to be contained even when it is set to 480 MPa grade (TS is set to 480 MPa or more). However, in the steel having 95% or more of a soft ferrite phase, a decrease in ductility becomes an issue when the strength of 480 MPa or more is secured by precipitation strengthening of TiC. Further, in the technique disclosed in Patent Reference 2, addition of rare metals such as La and Ce becomes essential. Thus, the technique disclosed in Patent Reference 2 has a task of alloying element limitation.

Further, as described above, the demand for application of a high-strength steel sheet to automotive members has been growing recently. When the high-strength steel sheet is formed by pressing in cold working, cracking is likely to occur from an edge of a portion to be subjected to stretch flange forming during forming. This is conceivable because work hardening advances only in the edge portion due to the strain introduced into a punched end face at the time of blanking. Conventionally, as an evaluation method of a stretch flangeability test, a hole expansion test has been used. However, in the hole expansion test, the sheet leads to a fracture with little or no strain distributed in a circumferential direction, but in actual part working, a strain distribution exists, and thus the effect on a fracture limit by strain and stress gradient around a fractured portion exists. Accordingly, even when sufficient stretch flangeability is exhibited in the hole expansion test in the case of the high-strength steel sheet, cracking sometimes occurs due to the strain distribution in the case where cold pressing is performed.

Patent References 1, 2 disclose that only the structure to be observed by an optical microscope is defined, to thereby improve the hole expandability. However, it is unclear whether sufficient stretch flangeability can be secured even in the case where the strain distribution is considered.

As a method of increasing the yield stress, for example, there are methods of (1) work hardening, (2) forming a microstructure mainly composed of a low-temperature transformation phase (bainite.martensite) having a high dislocation density, (3) adding solid-solution strengthening elements, and (4) performing precipitation strengthening. In the methods of (1) and (2), the dislocation density increases, thus leading to a great deterioration in workability. In the method of performing solid-solution strengthening of (3), there is a limitation in the absolute value of its strengthening amount, resulting in that it is difficult to sufficiently increase the yield stress. Thus, in order to increase the yield stress efficiently while obtaining high workability, elements such as Nb, Ti, Mo, and V are added and precipitation strengthening of these alloy carbonitrides is performed, to thereby achieve a high yield stress desirably.

From the above-described aspects, the practical application of a high-strength steel sheet utilizing precipitation strengthening of microalloy elements has been in progress, but it is necessary to overcome the above-described fatigue property and rust prevention in this high-strength steel sheet utilizing the precipitation strengthening.

Regarding the fatigue property, there exists a phenomenon in which a fatigue strength deteriorates due to softening of a surface layer of the steel sheet in the high-strength steel sheet utilizing the precipitation strengthening. In the surface of the steel sheet that directly comes into contact with a rolling roll during hot rolling, by a heat removal effect of the roll in contact with the steel sheet, the temperature of only the surface of the steel sheet decreases. When the uppermost surface layer of the steel sheet falls below the Ara point, coarsening of the microstructure and precipitates occurs and the uppermost surface layer of the steel sheet softens. This is the main reason for the fatigue strength deterioration. Generally, as the uppermost surface layer of the steel sheet becomes harder, the fatigue strength of a steel product improves. Therefore, under the present circumstances, it is difficult to obtain a high fatigue strength in a high-tensile steel sheet utilizing the precipitation strengthening. Originally, the purpose of increasing the steel sheet in strength is to reduce the weight of the vehicle body weight, and thus it is impossible to reduce the sheet thickness when the fatigue strength decreases in spite of the increase in strength of the steel sheet. From this aspect, a fatigue strength ratio is desired to be 0.45 or more, and even in a high-strength hot-rolled steel sheet, the tensile strength and the fatigue strength are desirably maintained to high values in a well-balanced manner. Incidentally, the fatigue strength ratio is a value obtained by dividing, of the steel sheet, the fatigue strength by the tensile strength. Generally, the fatigue strength tends to increase as the tensile strength increases, but in a higher-strength material, the fatigue strength ratio decreases. Therefore, there is sometimes a case that even when a steel sheet having a high tensile strength is used, the fatigue strength does not increase, failing to achieve the weight reduction of the vehicle body weight, which is the purpose of increasing the strength.

CITATION LIST

Patent Reference

Patent Reference 1: International Publication Pamphlet No. WO2013/161090

Patent Reference 2: Japanese Laid-open Patent Publication No. 2005-256115

Patent Reference 3: Japanese Laid-open Patent Publication No. 2011-140671

SUMMARY OF INVENTION

Technical Problem

An object of the present invention is to provide a steel sheet and a plated steel sheet that have strict stretch flangeability and excellent fatigue property and elongation while having high strength.

Solution to Problem

According to the conventional findings, the improvement of the stretch flangeability (hole expansibility) in the high-strength steel sheet has been performed by inclusion control, homogenization of structure, unification of structure, and/or reduction in hardness difference between structures, as described in Patent References 1 to 3. In other words, conventionally, the improvement in the stretch flangeability has been achieved by controlling the structure to be observed by an optical microscope.

However, it is difficult to improve the stretch flangeability under the presence of the strain distribution even when only the structure to be observed by an optical microscope is controlled. Thus, the present inventors made an intensive study by focusing on an intragranular misorientation of each crystal grain. As a result, they found out that it is possible to greatly improve the stretch flangeability by controlling the proportion of crystal grains each having a misorientation in a crystal grain of 5 to 14° to all crystal grains to 20 to 100%.

Further, the present inventors found out that it is possible to obtain an excellent fatigue property as long as the total precipitate density of Ti(C,N) and Nb(C,N) each having a circle-equivalent diameter of 10 nm or less is $10^{10}$ precipitates/$mm^3$ or more and the ratio (Hvs/Hvc) of the hardness (Hvs) at 20 μm in depth from the surface to the hardness (Hvc) at the center of the sheet thickness is 0.85 or more.

The present invention was completed as a result that the present inventors conducted intensive studies repeatedly based on the new findings relating to the above-described proportion of the crystal grains each having a misorientation in a crystal grain of 5 to 14° to all the crystal grains and the new findings relating to the hardness ratio.

The gist of the present invention is as follows.

(1)

A steel sheet, includes:

a chemical composition represented by, in mass %,

C: 0.008 to 0.150%,

Si: 0.01 to 1.70%,

Mn: 0.60 to 2.50%,

Al: 0.010 to 0.60%,

Ti: 0 to 0.200%,

Nb: 0 to 0.200%,

Ti+Nb: 0.015 to 0.200%,

Cr: 0 to 1.0%,

B: 0 to 0.10%,

Mo: 0 to 1.0%,

Cu: 0 to 2.0%,

Ni: 0 to 2.0%,

Mg: 0 to 0.05%,

REM: 0 to 0.05%,

Ca: 0 to 0.05%,

Zr: 0 to 0.05%,

P: 0.05% or less,

S: 0.0200% or less,

N: 0.0060% or less, and balance: Fe and impurities; and a structure represented by, by area ratio, ferrite: 5 to 60%, and bainite: 40 to 95%, in which when a region that is surrounded by a grain boundary having a misorientation of 15° or more and has a circle-equivalent diameter of 0.3 μm or more is defined as a crystal grain, the proportion of crystal grains each having an intragranular misorientation of 5 to 14° to all crystal grains is 20 to 100% by area ratio, a precipitate density of Ti(C,N) and Nb(C,N) each having a circle-equivalent diameter of 10 nm or less is $10^{10}$ precipitates/$mm^3$ or more, and a ratio (Hvs/Hvc) of a hardness at 20 μm in depth from a surface (Hvs) to a hardness of the center of a sheet thickness (Hvc) is 0.85 or more.

(2)

The steel sheet according to (1), in which an average dislocation density is $1\times10^{14}$ $m^{-2}$ or less.

(3)

The steel sheet according to (1) or (2), in which a tensile strength is 480 MPa or more, a ratio of the tensile strength and a yield strength is 0.80 or more, the product of the tensile strength and a limit form height in a saddle-type stretch-flange test is 19500 mm·MPa or more, and a fatigue strength ratio is 0.45 or more.

(4)

The steel sheet according to any one of (1) to (3), in which the chemical composition contains, in mass %, one type or more selected from the group consisting of Cr: 0.05 to 1.0%, and B: 0.0005 to 0.10%.

(5)

The steel sheet according to any one of (1) to (4), in which the chemical composition contains, in mass %, one type or more selected from the group consisting of Mo: 0.01 to 1.0%, Cu: 0.01 to 2.0%, and Ni: 0.01% to 2.0%.

(6)

The steel sheet according to any one of (1) to (5), in which the chemical composition contains, in mass %, one type or more selected from the group consisting of Ca: 0.0001 to 0.05%, Mg: 0.0001 to 0.05%, Zr: 0.0001 to 0.05%, and REM: 0.0001 to 0.05%.

(7)

A plated steel sheet, in which a plating layer is formed on a surface of the steel sheet according to any one of (1) to (6).

(8)

The plated steel sheet according to (7), in which the plating layer is a hot-dip galvanizing layer.

(9)

The plated steel sheet according to (7), in which the plating layer is an alloyed hot-dip galvanizing layer.

Advantageous Effects of Invention

According to the present invention, it is possible to provide a steel sheet and a plated steel sheet that are applicable to members that require strict ductility and stretch flangeability and have an excellent fatigue property while having high strength. This makes it possible to fabricate a steel sheet excellent in crashworthiness.

DESCRIPTION OF EMBODIMENTS

Figure 1A:
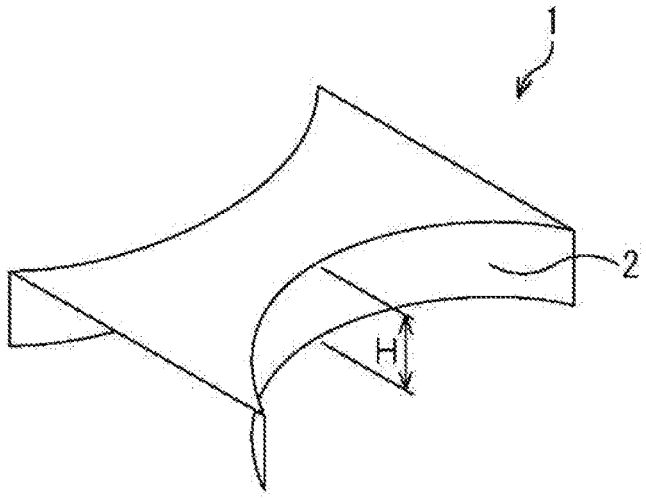
FIG. 1A is a perspective view illustrating a saddle-type formed product to be used for a saddle-type stretch-flange test method.

Hereinafter, there will be explained embodiments of the present invention.

[Chemical Composition]

First, there will be explained a chemical composition of a steel sheet according to the embodiment of the present invention. In the following explanation, "%" that is a unit of the content of each element contained in the steel sheet means "mass %" unless otherwise stated. The steel sheet according to this embodiment has a chemical composition represented by C: 0.008 to 0.150%, Si: 0.01 to 1.70%, Mn: 0.60 to 2.50%, Al: 0.010 to 0.60%, Ti: 0 to 0.200%, Nb: 0 to 0.200%, Ti+Nb: 0.015 to 0.200%, Cr: 0 to 1.0%, B: 0 to 0.10%, Mo: 0 to 1.0%, Cu: 0 to 2.0%, Ni: 0 to 2.0%, Mg: 0 to 0.05%, rare earth metal (REM): 0 to 0.05%, Ca: 0 to 0.05%, Zr: 0 to 0.05%, P: 0.05% or less, S: 0.0200% or less, N: 0.0060% or less, and balance: Fe and impurities. Examples of the impurities include one contained in raw materials such as ore and scrap, and one contained during a manufacturing process.

"C: 0.008 to 0.150%"

C bonds to Nb, Ti, and so on to form precipitates in the steel sheet and contributes to an improvement in strength of steel by precipitation strengthening. When the C content is less than 0.008%, it is impossible to sufficiently obtain this effect. Therefore, the C content is set to 0.008% or more. The C content is preferably set to 0.010% or more, and more preferably set to 0.018% or more. On the other hand, when the C content is greater than 0.150%, an orientation spread in bainite is likely to increase and the proportion of crystal grains each having an intragranular misorientation of 5 to 14° becomes short. Further, when the C content is greater than 0.150%, cementite harmful to the stretch flangeability increases and the stretch flangeability deteriorates. Therefore, the C content is set to 0.150% or less. The C content is preferably set to 0.100% or less and more preferably set to 0.090% or less.

"Si: 0.01 to 1.70%"

Si functions as a deoxidizer for molten steel. When the Si content is less than 0.01%, it is impossible to sufficiently obtain this effect. Therefore, the Si content is set to 0.01% or more. The Si content is preferably set to 0.02% or more and more preferably set to 0.03% or more. On the other hand, when the Si content is greater than 1.70%, the stretch flangeability deteriorates or surface flaws occur. Further, when the Si content is greater than 1.70%, the transformation point rises too much, to then require an increase in rolling temperature. In this case, recrystallization during hot rolling is promoted significantly and the proportion of the crystal grains each having an intragranular misorientation of 5 to 14° becomes short. Further, when the Si content is greater than 1.70%, surface flaws are likely to occur when a plating layer is formed on the surface of the steel sheet. Therefore, the Si content is set to 1.70% or less. The Si content is preferably set to 1.60% or less, more preferably set to 1.50% or less, and further preferably set to 1.40% or less.

"Mn: 0.60 to 2.50%"

Mn contributes to the strength improvement of the steel by solid-solution strengthening or improving hardenability of the steel. When the Mn content is less than 0.60%, it is impossible to sufficiently obtain this effect. Therefore, the Mn content is set to 0.60% or more. The Mn content is preferably set to 0.70% or more and more preferably set to 0.80% or more. On the other hand, when the Mn content is greater than 2.50%, the hardenability becomes excessive and the degree of orientation spread in bainite increases. As a result, the proportion of the crystal grains each having an intragranular misorientation of 5 to 14° becomes short and the stretch flangeability deteriorates. Therefore, the Mn content is set to 2.50% or less. The Mn content is preferably set to 2.30% or less and more preferably set to 2.10% or less.

"Al: 0.010 to 0.60%"

Al is effective as a deoxidizer for molten steel. When the Al content is less than 0.010%, it is impossible to sufficiently obtain this effect. Therefore, the Al content is set to 0.010% or more. The Al content is preferably set to 0.020% or more and more preferably set to 0.030% or more. On the other hand, when the Al content is greater than 0.60%, weldability, toughness, and so on deteriorate. Therefore, the Al content is set to 0.60% or less. The Al content is preferably set to 0.50% or less and more preferably set to 0.40% or less.

"Ti: 0 to 0.200%, Nb: 0 to 0.200%, Ti+Nb: 0.015 to 0.200%"

Ti and Nb finely precipitate in the steel as carbides (TiC, NbC) and improve the strength of the steel by precipitation strengthening. Further, Ti and Nb form carbides to thereby fix C, resulting in that generation of cementite harmful to the stretch flangeability is suppressed. That is, Ti and Nb are important for precipitating TiC during annealing and increasing the strength. Although details will be described later, a method of utilizing Ti and Nb in this embodiment will be described here, too. In a manufacturing step, at a hot rolling stage (stage from hot rolling till coiling), it is necessary to bring Ti and Nb into a solid-solution state partly, and thus a coiling temperature during hot rolling is set to 620° or less at which Ti precipitates and Nb precipitates are not likely to occur. Then, it is important to introduce dislocations by performing skin pass rolling before annealing. Next, at an annealing stage, Ti(C,N) and Nb(C,N) finely precipitate on the introduced dislocations. Near the surface layer of the steel sheet where the dislocation density increases, in particular, an effect (the fine precipitation of Ti(C,N) and Nb(C,N)) becomes prominent. This effect makes it possible to establish Hvs/Hvc 0.85, resulting in that it is possible to achieve a high fatigue property. Further, by precipitation strengthening of Ti and Nb, the ratio of a tensile strength and a yield strength (a yield ratio) can be made 0.80 or more. When the total content of Ti and Nb is less than 0.015%, it is impossible to sufficiently obtain these effects. Therefore, the total content of Ti and Nb is set to 0.015% or more. The total content of Ti and Nb is preferably set to 0.020% or more. When the total content of Ti and Nb is less than 0.015%, the workability deteriorates and the frequency of cracking during rolling increases. Further, the Ti content is preferably set to 0.025% or more, more preferably set to 0.035% or more, and further preferably set to 0.025% or more. Further, the Nb content is preferably set to 0.025% or more and more preferably set to 0.035% or more. On the other hand, when the total content of Ti and Nb exceeds 0.200%, the proportion of the crystal grains each having an intragranular misorientation of 5 to 14° becomes short and the stretch flangeability deteriorates greatly. Therefore, the total content of Ti and Nb is set to 0.200% or less. The total content of Ti and Nb is preferably set to 0.150% or less.

"P: 0.05% or Less"

P is an impurity. P deteriorates toughness, ductility, weldability, and so on, and thus a lower P content is more preferable. When the P content is greater than 0.05%, the deterioration in stretch flangeability is prominent. Therefore, the P content is set to 0.05% or less. The P content is preferably set to 0.03% or less and more preferably set to 0.02% or less. The lower limit of the P content is not determined in particular, but its excessive reduction is not desirable from the viewpoint of manufacturing cost. Therefore, the P content may be set to 0.005% or more.

"S: 0.0200% or Less"

S is an impurity. S causes cracking at the time of hot rolling, and further forms A-based inclusions that deteriorate the stretch flangeability. Thus, a lower S content is more preferable. When the S content is greater than 0.0200%, the deterioration in stretch flangeability is prominent. Therefore, the S content is set to 0.0200% or less. The S content is preferably set to 0.0150% or less and more preferably set to 0.0060% or less. The lower limit of the S content is not determined in particular, but its excessive reduction is not desirable from the viewpoint of manufacturing cost. Therefore, the S content may be set to 0.0010% or more.

"N: 0.0060% or Less"

N is an impurity. N forms precipitates with Ti and Nb preferentially over C and reduces Ti and Nb effective for fixation of C. Thus, a lower N content is more preferable. When the N content is greater than 0.0060%, the deterioration in stretch flangeability is prominent. Therefore, the N content is set to 0.0060% or less. The N content is preferably set to 0.0050% or less. The lower limit of the N content is not determined in particular, but its excessive reduction is not desirable from the viewpoint of manufacturing cost. Therefore, the N content may be set to 0.0010% or more.

Cr, B, Mo, Cu, Ni, Mg, REM, Ca, and Zr are not essential elements, but are arbitrary elements that may be contained as needed in the steel sheet up to predetermined amounts.

"Cr: 0 to 1.0%"

Cr contributes to the strength improvement of the steel. Desired purposes are achieved without Cr being contained, but in order to sufficiently obtain this effect, the Cr content is preferably set to 0.05% or more. On the other hand, when the Cr content is greater than 1.0%, the above-described effect is saturated and economic efficiency decreases. Therefore, the Cr content is set to 1.0% or less.

"B: 0 to 0.10%"

B increases the hardenability and increases a structural fraction of a low-temperature transformation generating phase being a hard phase. Desired purposes are achieved without B being contained, but in order to sufficiently obtain this effect, the B content is preferably set to 0.0005% or more. On the other hand, when the B content is greater than 0.10%, the above-described effect is saturated and economic efficiency decreases. Therefore, the B content is set to 0.10% or less.

"Mo: 0 to 1.0%"

Mo improves the hardenability, and at the same time, has an effect of increasing the strength by forming carbides. Desired purposes are achieved without Mo being contained, but in order to sufficiently obtain this effect, the Mo content is preferably set to 0.01% or more. On the other hand, when the Mo content is greater than 1.0%, the ductility and the weldability sometimes decrease. Therefore, the Mo content is set to 1.0% or less.

"Cu: 0 to 2.0%"

Cu increases the strength of the steel sheet, and at the same time, improves corrosion resistance and removability of scales. Desired purposes are achieved without Cu being contained, but in order to sufficiently obtain this effect, the Cu content is preferably set to 0.01% or more and more preferably set to 0.04% or more. On the other hand, when the Cu content is greater than 2.0%, surface flaws sometimes occur. Therefore, the Cu content is set to 2.0% or less and preferably set to 1.0% or less.

"Ni: 0 to 2.0%"

Ni increases the strength of the steel sheet, and at the same time, improves the toughness. Desired purposes are achieved without Ni being contained, but in order to sufficiently obtain this effect, the Ni content is preferably set to 0.01% or more. On the other hand, when the Ni content is greater than 2.0%, the ductility decreases. Therefore, the Ni content is set to 2.0% or less.

"Mg: 0 to 0.05%, REM: 0 to 0.05%, Ca: 0 to 0.05%, Zr: 0 to 0.05%"

Ca, Mg, Zr, and REM all improve toughness by controlling shapes of sulfides and oxides. Desired purposes are achieved without Ca, Mg, Zr, and REM being contained, but in order to sufficiently obtain this effect, the content of one type or more selected from the group consisting of Ca, Mg, Zr, and REM is preferably set to 0.0001% or more and more preferably set to 0.0005% or more. On the other hand, when the content of Ca, Mg, Zr, or REM is greater than 0.05%, the stretch flangeability deteriorates. Therefore, the content of each of Ca, Mg, Zr, and REM is set to 0.05% or less.

"Metal Structure"

Next, there will be explained a structure (metal microstructure) of the steel sheet according to the embodiment of the present invention. In the following explanation, "%" that is a unit of the proportion (area ratio) of each structure means "area %" unless otherwise stated. The steel sheet according to this embodiment has a structure represented by ferrite: 5 to 60% and bainite: 40 to 95%.

"Ferrite: 5 to 60%"

When the area ratio of the ferrite is less than 5%, the ductility of the steel sheet deteriorates, resulting in a difficulty in securing properties generally required for automotive members, and so on. Therefore, the area ratio of the ferrite is set to 5% or more. On the other hand, when the area ratio of the ferrite is greater than 60%, the stretch flangeability deteriorates or it becomes difficult to obtain sufficient strength. Therefore, the area ratio of the ferrite is set to 60% or less. The area ratio of the ferrite is preferably set to less than 50%, more preferably set to less than 40%, and further preferably set to less than 30%.

"Bainite: 40 to 95%"

When the area ratio of the bainite is 40% or more, it is possible to expect the increase in strength by precipitation strengthening. That is, as will be described later, in a manufacturing method of the steel sheet according to this embodiment, the coiling temperature of a hot-rolled steel sheet is set to 630° C. or less to secure solid-solution Ti and solid-solution Nb in the steel sheet, but this temperature is close to the bainite transformation temperature. Therefore, bainite in large amounts is contained in the microstructure of the steel sheet and a transformation dislocation to be introduced simultaneously with transformation increases nucleation sites of TiC and NbC at an annealing time, and thus larger precipitation strengthening is achieved. Although the area ratio of the bainite changes greatly depending on the cooling history during hot rolling, the area ratio of the bainite is adjusted according to required material properties. The area ratio of the bainite is preferably set to greater than 50%, and thereby, the increase in strength by precipitation strengthening becomes larger, and further coarse cementite poor in press formability is reduced and the press formability is maintained well. The area ratio of the bainite is more preferably set to greater than 60% and further preferably set to greater than 70%. The area ratio of the bainite is set to 95% or less and preferably set to 80% or less.

The microstructure of the steel sheet according to this embodiment may contain metal microstructures other than the ferrite and the bainite as a structure of the balance. Examples of the metal microstructure other than the ferrite and the bainite include martensite, retained austenite, pearlite, and so on. However, when the fraction (area ratio) of the structure of the balance is large, the deterioration in stretch flangeability is concerned. Therefore, the area ratio of the structure of the balance is preferably set to 10% or less in total. In other words, the total of the ferrite and the bainite in the structure is preferred to be 90% or more by area ratio. The total of the ferrite and the bainite is more preferred to be 100% by area ratio.

In the manufacturing method of the steel sheet according to this embodiment, at the hot rolling stage (stage from hot rolling till coiling), part of Ti and Ni in the steel sheet is brought into a solid-solution state, and then by skin pass rolling after hot rolling, strains are introduced into the surface layer. Then, at the annealing stage, the introduced strains are used as nucleation sites to precipitate Ti(C,N) and Nb(C,N) in the surface layer. In this manner, the improvement of the fatigue property is performed. Therefore, it is important to complete the hot rolling at 630° C. or less at which precipitation of Ti and Nb does not easily progress. That is, it is important to coil a hot-rolled product at a temperature of 630° C. or less. It does not matter that the fraction of the bainite is arbitrary within the above-described range in the microstructure of the steel sheet obtained by coiling the hot-rolled product (structure at the hot rolling stage). In the case where it is desired to increase the elongation of a product (high-strength steel sheet, hot-dip plated steel sheet, or alloyed hot-dip plated steel sheet), in particular, it is effective to increase the fraction of the ferrite during hot rolling.

The microstructure of the steel sheet at the hot rolling stage contains bainite and martensite, to thus have a high dislocation density. However, the bainite and the martensite are tempered during annealing, and thus the dislocation density decreases. When an annealing time is insufficient, the dislocation density remains high and the elongation is low. Therefore, the average dislocation density of the steel sheet after annealing is preferred to be $1\times10^{14}$ $m^{-2}$ or less. In the case where the annealing is performed under the condition that satisfies Expressions (4), (5) to be described later, the decrease in the dislocation density progresses simultaneously with precipitation of Ti(C,N) and NB(C,N). That is, in a state where the precipitation of Ti(C,N) and Nb(C,N) progresses sufficiently, the average dislocation density of the steel sheet decreases. Typically, the decrease in the dislocation density leads to a decrease in yield stress of a steel product. However, in this embodiment, Ti(C,N) and Nb(C,N) precipitate simultaneously with the decrease in the dislocation density, and therefore, a high yield stress is obtained. In this embodiment, a measurement method of the dislocation density is performed according to "Method of evaluating a dislocation density using X-ray diffraction" described in CAMP-ISIJ Vol. 17 (2004) p. 396, and the average dislocation density is calculated from full widths at half maximum of (110), (211), and (220).

The microstructure has the above-described characteristics, thereby making it possible to achieve a high yield ratio and a high fatigue strength ratio that were not able to be achieved in a steel sheet on which precipitation strengthening in the prior technique was performed. That is, even when the microstructure near the surface layer of the steel sheet is mainly composed of ferrite and exhibits a coarse structure unlike the microstructure in the sheet thickness center portion, the hardness near the surface layer of the steel sheet reaches the hardness substantially equivalent to that of the center portion of the steel sheet due to the precipitation of Ti(C,N) and Nb(C,N) during annealing. As a result, occurrence of fatigue cracks is suppressed and the fatigue strength ratio increases.

The proportion (area ratio) of each structure can be obtained by the following method. First, a sample collected from the steel sheet is etched by nital. After the etching, a structure photograph obtained at a ¼ depth position of the sheet thickness in a visual field of 300 μm×300 μm is subjected to an image analysis by using an optical microscope. By this image analysis, the area ratio of ferrite, the area ratio of pearlite, and the total area ratio of bainite and martensite are obtained. Then, a sample etched by LePera is used, and a structure photograph obtained at a ¼ depth position of the sheet thickness in a visual field of 300 μm×300 μm is subjected to an image analysis by using an optical microscope. By this image analysis, the total area ratio of retained austenite and martensite is obtained. Further, a sample obtained by grinding the surface to a depth of ¼ of the sheet thickness from a direction normal to a rolled surface is used, and the volume fraction of retained austenite is obtained through an X-ray diffraction measurement. The volume fraction of the retained austenite is equivalent to the area ratio, and thus is set as the area ratio of the retained austenite. Then, the area ratio of martensite is obtained by subtracting the area ratio of the retained austenite from the total area ratio of the retained austenite and the martensite, and the area ratio of bainite is obtained by subtracting the area ratio of the martensite from the total area ratio of the bainite and the martensite. In this manner, it is possible to obtain the area ratio of each of ferrite, bainite, martensite, retained austenite, and pearlite.

"Precipitate Density"

In order to obtain an excellent yield ratio (ratio of the yield strength and the tensile strength), the precipitation strengthening by Ti(C,N), Nb(C,N), and so on to precipitate by tempering of bainite becomes more extremely important than transformation strengthening by a hard phase such as martensite. In this embodiment, the total precipitate density of Ti(C,N) and Nb(C,N) each having a circle-equivalent diameter of 10 nm or less, which is effective for the precipitation strengthening, is set to $10^{10}$ precipitates/$mm^3$ or more. This makes it possible to achieve a yield ratio of 0.80 or more. Here, precipitates each having a circle-equivalent diameter of greater than 10 nm, which is obtained as the square root of (major axis×minor axis), do not affect the properties obtained in the present invention. However, as the size of the precipitate becomes finer, the precipitation strengthening by Ti(C,N) and Nb(C,N) is obtained more effectively, and as a result, there is a possibility that the content of contained alloy elements can be reduced. Therefore, the total precipitate density of Ti(C,N) and Nb(C,N) each having a circle-equivalent diameter of 10 nm or less is defined. A precipitate observation is performed by observing a replica sample fabricated according to a method described in Japanese Laid-open Patent Publication No. 2004-317203 by a transmission electron microscope. The visual fields are set at 5000-fold to 100000-fold magnification, and the number of Ti(C,N) and Nb(C,N) each having 10 nm or less is counted from 3 or more visual fields. Then, an electrolytic weight is obtained from a change in weight before and after electrolysis, and the weight is converted into a volume by a specific gravity of 7.8 ton/$m^3$. Then, the counted number is divided by the volume, and thereby, the total precipitate density is calculated.

"Hardness Distribution"

The present inventors found out that in order to improve the fatigue property, the elongation, and the crashworthiness, in a high-strength steel sheet utilizing precipitation strengthening by microalloy elements, the ratio of the hardness of the surface layer of the steel sheet to the hardness of the center portion of the steel sheet is set to 0.85 or more, and thereby the fatigue property improves. Here, the hardness of the surface layer of the steel sheet means a hardness at the position of 20 μm in depth from the surface to the inside in a cross section of the steel sheet, and this is referred to as Hvs. Further, the hardness of the center portion of the steel sheet means a hardness at the position of ¼ inner side of the sheet thickness from the surface of the steel sheet in a cross section of the steel sheet, and this is referred to as Hvc. The present inventors found out that in the case of the ratio Hvs/Hvc being less than 0.85, the fatigue property deteriorates, and on the other hand, in the case of Hvs/Hvc being 0.85 or more, the fatigue property improves. Thus, Hvs/Hvc is set to 0.85 or more.

In the steel sheet according to this embodiment, in the case where a region surrounded by a grain boundary having a misorientation of 15° or more and having a circle-equivalent diameter of 0.3 μm or more is defined as a crystal grain, the proportion of crystal grains each having an intragranular misorientation of 5 to 14° to all crystal grains is 20 to 100% by area ratio. The intragranular misorientation is obtained by using an electron back scattering diffraction (EBSD) method that is often used for a crystal orientation analysis. The intragranular misorientation is a value in the case where a boundary having a misorientation of 15° or more is set as a grain boundary in a structure and a region surrounded by this grain boundary is defined as a crystal grain.

The crystal grains each having an intragranular misorientation of 5 to 14° are effective for obtaining a steel sheet excellent in the balance between strength and workability. The proportion of the crystal grains each having an intragranular misorientation of 5 to 14° is increased, thereby making it possible to improve the stretch flangeability while maintaining desired strength of the steel sheet. When the proportion of the crystal grains each having an intragranular misorientation of 5 to 14° to all the crystal grains is 20% or more by area ratio, desired strength and stretch flangeability of the steel sheet can be obtained. It does not matter that the proportion of the crystal grains each having an intragranular misorientation of 5 to 14° is high, and thus its upper limit is 100%.

A cumulative strain at the final three stages of finish rolling is controlled as will be described later, and thereby crystal misorientation occurs in grains of ferrite and bainite. The reason for this is considered as follows. By controlling the cumulative strain, dislocation in austenite increases, dislocation walls are made in an austenite grain at a high density, and some cell blocks are formed. These cell blocks have different crystal orientations. It is conceivable that austenite that has a high dislocation density and contains the cell blocks having different crystal orientations is transformed, and thereby, ferrite and bainite also include crystal misorientations even in the same grain and the dislocation density also increases. Thus, the intragranular crystal misorientation is conceived to correlate with the dislocation density contained in the crystal grain. Generally, the increase in the dislocation density in a grain brings about an improvement in strength, but lowers the workability. However, the crystal grains each having an intragranular misorientation controlled to 5 to 14° make it possible to improve the strength without lowering the workability. Therefore, in the steel sheet according to this embodiment, the proportion of the crystal grains each having an intragranular misorientation of 5 to 14° is set to 20% or more. The crystal grains each having an intragranular misorientation of less than 5° are excellent in workability, but have difficulty in increasing the strength. The crystal grains each having an intragranular misorientation of greater than 14° do not contribute to the improvement in stretch flangeability because they are different in deformability among the crystal grains.

The proportion of the crystal grains each having an intragranular misorientation of 5 to 14° can be measured by the following method. First, at a ¼ depth position of a sheet thickness t from the surface of the steel sheet (¼ t portion) in a cross section vertical to a rolling direction, a region of 200 μm in the rolling direction and 100 μm in a direction normal to the rolled surface is subjected to an EBSD analysis at a measurement pitch of 0.2 μm to obtain crystal orientation information. Here, the EBSD analysis is performed by using an apparatus that is composed of a thermal field emission scanning electron microscope (JSM-7001F manufactured by JEOL Ltd.) and an EBSD detector (HIKARI detector manufactured by TSL Co., Ltd.), at an analysis speed of 200 to 300 points/second. Then, with respect to the obtained crystal orientation information, a region having a misorientation of 15° or more and a circle-equivalent diameter of 0.3 μm or more is defined as a crystal grain, the average intragranular misorientation of crystal grains is calculated, and the proportion of the crystal grains each having an intragranular misorientation of 5 to 14° is obtained. The crystal grain defined as described above and the average intragranular misorientation can be calculated by using software "OIM Analysis (registered trademark)" attached to an EBSD analyzer.

The "intragranular misorientation" in this embodiment means "Grain Orientation Spread (GOS)" that is an orientation spread in a crystal grain. The value of the intragranular misorientation is obtained as an average value of misorientations between the reference crystal orientation and all measurement points in the same crystal grain as described in "Misorientation Analysis of Plastic Deformation of Stainless Steel by EBSD and X-ray Diffraction Methods," KIMURA Hidehiko, et al., Transactions of the Japan Society of Mechanical Engineers (series A), Vol. 71, No. 712, 2005, p. 1722-1728. In this embodiment, the reference crystal orientation is an orientation obtained by averaging all the measurement points in the same crystal grain. The value of GOS can be calculated by using software "OIM Analysis (registered trademark) Version 7.0.1" attached to the EBSD analyzer.

In the steel sheet according to this embodiment, the area ratios of the respective structures observed by an optical microscope such as ferrite and bainite and the proportion of the crystal grains each having an intragranular misorientation of 5 to 14° have no direct relation. In other words, for example, even if there are steel sheets having the same area ratio of ferrite and the same area ratio of bainite, they are not necessarily the same in the proportion of the crystal grains each having an intragranular misorientation of 5 to 14°. Accordingly, it is impossible to obtain properties equivalent to those of the steel sheet according to this embodiment only by controlling the area ratio of ferrite and the area ratio of bainite.

Figure 1B:
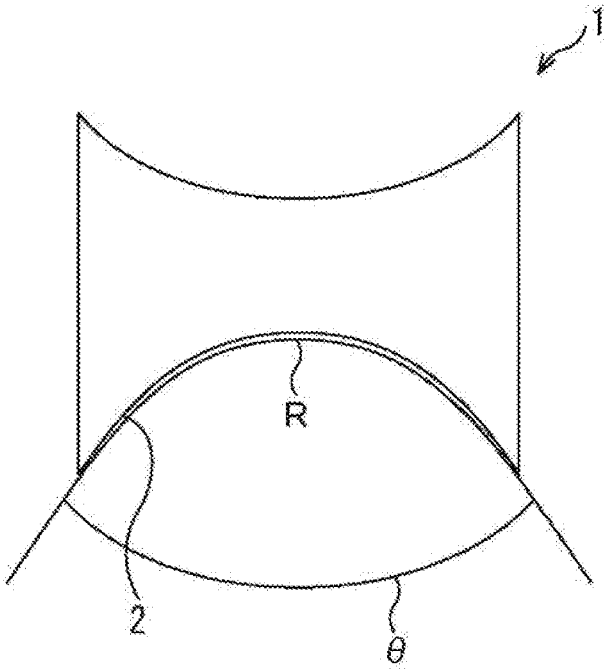
FIG. 1B is a plan view illustrating the saddle-type formed product to be used for the saddle-type stretch-flange test method.

In this embodiment, the stretch flangeability is evaluated by a saddle-type stretch-flange test method using a saddle-type formed product. FIG. 1A and FIG. 1B are views each illustrating a saddle-type formed product to be used for a saddle-type stretch-flange test method in this embodiment, FIG. 1A is a perspective view, and FIG. 1B is a plan view. In the saddle-type stretch-flange test method, concretely, a saddle-type formed product 1 simulating the stretch flange shape formed of a linear portion and an arc portion as illustrated in FIG. 1A and FIG. 1B is pressed, and the stretch flangeability is evaluated by using a limit form height at that time. In the saddle-type stretch-flange test method in this embodiment, a limit form height H (mm) obtained when a clearance at the time of punching a corner portion 2 is set to 11% is measured by using the saddle-type formed product 1 in which a radius of curvature R of the corner portion 2 is set to 50 to 60 mm and an opening angle θ of the corner portion 2 is set to 120°. Here, the clearance indicates the ratio of a gap between a punching die and a punch and the thickness of the test piece. Actually, the clearance is determined by the combination of a punching tool and the sheet thickness, to thus mean that 11% satisfies a range of 10.5 to 11.5%. As for determination of the limit form height H, whether or not a crack having a length of ⅓ or more of the sheet thickness exists is visually observed after forming, and then a limit form height with no existence of cracks is determined as the limit form height.

In a conventional hole expansion test used as a test method coping with the stretch flangeability, the sheet leads to a fracture with little or no strain distributed in a circumferential direction. Therefore, the strain and the stress gradient around a fractured portion differ from those at an actual stretch flange forming time. Further, in the hole expansion test, evaluation is made at the point in time when a fracture occurs penetrating the sheet thickness, or the like, resulting in that the evaluation reflecting the original stretch flange forming is not made. On the other hand, in the saddle-type stretch-flange test used in this embodiment, the stretch flangeability considering the strain distribution can be evaluated, and thus the evaluation reflecting the original stretch flange forming can be made.

According to the steel sheet according to this embodiment, a tensile strength of 480 MPa or more can be obtained. That is, an excellent tensile strength can be obtained. The upper limit of the tensile strength is not limited in particular. However, in a component range in this embodiment, the upper limit of the practical tensile strength is about 1180 MPa. The tensile strength can be measured by fabricating a No. 5 test piece described in JIS-Z2201 and performing a tensile test according to a test method described in JIS-Z2241.

According to the steel sheet according to this embodiment, a yield strength of 380 MPa or more can be obtained. That is, an excellent yield strength can be obtained. The upper limit of the yield strength is not limited in particular. However, in a component range in this embodiment, the upper limit of the practical yield strength is about 900 MPa. The yield strength can also be measured by fabricating a No. 5 test piece described in JIS-Z2201 and performing a tensile test according to a test method described in JIS-Z2241.

According to the steel sheet according to this embodiment, a yield ratio (ratio of the tensile strength and the yield strength) of 0.80 or more can be obtained. That is, an excellent yield ratio can be obtained. The upper limit of the yield ratio is not limited in particular. However, in a component range in this embodiment, the upper limit of the practical yield ratio is about 0.96.

According to the steel sheet according to this embodiment, the product of the tensile strength and the limit form height in the saddle-type stretch-flange test, which is 19500 mm·MPa or more, can be obtained. That is, excellent stretch flangeability can be obtained. The upper limit of this product is not limited in particular. However, in a component range in this embodiment, the upper limit of this practical product is about 25000 mm·MPa.

On the surface of the steel sheet in this embodiment, a plating layer may be formed. That is, a plated steel sheet can be cited as another embodiment of the present invention. The plating layer is, for example, an electroplating layer, a hot-dip plating layer, or an alloyed hot-dip plating layer. As the hot-dip plating layer and the alloyed hot-dip plating layer, a layer made of at least one of zinc and aluminum, for example, can be cited. Concretely, there can be cited a hot-dip galvanizing layer, an alloyed hot-dip galvanizing layer, a hot-dip aluminum plating layer, an alloyed hot-dip aluminum plating layer, a hot-dip Zn—Al plating layer, an alloyed hot-dip Zn—Al plating layer, and so on. From the viewpoints of platability and corrosion resistance, in particular, the hot-dip galvanizing layer and the alloyed hot-dip galvanizing layer are preferable.

A hot-dip plated steel sheet and an alloyed hot-dip plated steel sheet are manufactured by performing hot dipping or alloying hot dipping on the aforementioned steel sheet according to this embodiment. Here, the alloying hot dipping means that hot dipping is performed to form a hot-dip plating layer on a surface, and then an alloying treatment is performed thereon to form the hot-dip plating layer into an alloyed hot-dip plating layer. The hot-dip plated steel sheet and the alloyed hot-dip plated steel sheet include the steel sheet according to this embodiment and have the hot-dip plating layer and the alloyed hot-dip plating layer provided thereon respectively, and thereby, it is possible to achieve an excellent rust prevention property together with the functional effects of the steel sheet according to this embodiment. Before performing plating, Ni or the like may be applied to the surface as pre-plating.

The plated steel sheet according to the embodiment of the present invention has an excellent rust prevention property because the plating layer is formed on the surface of the steel sheet. Thus, when an automotive member is reduced in thickness by using the plated steel sheet in this embodiment, for example, it is possible to prevent shortening of the usable life of an automobile that is caused by corrosion of the member.

Next, there will be explained a method of manufacturing the steel sheet according to the embodiment of the present invention. In this method, hot rolling, first cooling, second cooling, first skin pass rolling, annealing, and second skin pass rolling are performed in this order.

"Hot Rolling"

The hot rolling includes rough rolling and finish rolling. In the hot rolling, a slab (steel billet) having the above-described chemical composition is heated to be subjected to rough rolling. A slab heating temperature is set to SRTmin° C. expressed by Expression (1) below or more and 1260° C. or less.

$$SRTmin=[7000/\{2.75-\log([Ti]\times[C])\}-273)+10000/\{4.29-\log([Nb]\times[C])\}-273)]/2. \quad (1)$$

Here, [Ti], [Nb], and [C] in Expression (1) represent the contents of Ti, Nb, and C in mass %.

When the slab heating temperature is less than SRTmin° C., Ti and/or Nb are/is not sufficiently brought into solution. When Ti and/or Nb are/is not brought into solution at the time of slab heating, it becomes difficult to make Ti and/or Nb finely precipitate as carbides (TiC, NbC) and improve the strength of the steel by precipitation strengthening. Further, when the slab heating temperature is less than SRTmin° C., it becomes difficult to fix C by formation of the carbides (TiC, NbC) to suppress generation of cementite harmful to a burring property. Further, when the slab heating temperature is less than SRTmin° C., the proportion of the crystal grains each having an intragranular crystal misorientation of 5 to 14° is likely to be short. Therefore, the slab heating temperature is set to SRTmin° C. or more. On the other hand, when the slab heating temperature is greater than 1260° C., the yield decreases due to scale-off. Therefore, the slab heating temperature is set to 1260° C. or less.

By finish rolling, a hot-rolled steel sheet is obtained. The cumulative strain at the final three stages (final three passes) in the finish rolling is set to 0.5 to 0.6 in order to set the proportion of the crystal grains each having an intragranular misorientation of 5 to 14° to 20%, and then later-described cooling is performed. This is due to the following reason. The crystal grains each having an intragranular misorientation of 5 to 14° are generated by being transformed in a paraequilibrium state at relatively low temperature. Therefore, the dislocation density of austenite before transformation is limited to a certain range in the hot rolling, and at the same time, the subsequent cooling rate is limited to a certain range, thereby making it possible to control generation of the crystal grains each having an intragranular misorientation of 5 to 14°.

That is, the cumulative strain at the final three stages in the finish rolling and the subsequent cooling are controlled, thereby making it possible to control the nucleation frequency of the crystal grains each having an intragranular misorientation of 5 to 14° and the subsequent growth rate. As a result, it is possible to control the area ratio of the crystal grains each having an intragranular misorientation of 5 to 14° in a steel sheet to be obtained after cooling. More concretely, the dislocation density of the austenite introduced by the finish rolling is mainly related to the nucleation frequency and the cooling rate after the rolling is mainly related to the growth rate.

When the cumulative strain at the final three stages in the finish rolling is less than 0.5, the dislocation density of the austenite to be introduced is not sufficient and the proportion of the crystal grains each having an intragranular misorientation of 5 to 14° becomes less than 20%. Therefore, the cumulative strain at the final three stages is set to 0.5 or more. On the other hand, when the cumulative strain at the final three stages in the finish rolling exceeds 0.6, recrystallization of the austenite occurs during the hot rolling and the accumulated dislocation density at a transformation time decreases. As a result, the proportion of the crystal grains each having an intragranular misorientation of 5 to 14° becomes less than 20%. Therefore, the cumulative strain at the final three stages is set to 0.6 or less.

The cumulative strain at the final three stages in the finish rolling (εeff.) is obtained by Expression (2) below.

$$\varepsilon eff.=\Sigma\varepsilon i(t,T) \quad (2)$$

Here, $\varepsilon i(t,T)=\varepsilon i0/\exp\{(t/\tau R)^{2/3}\}$, $\tau R=\tau 0\cdot\exp(Q/RT)$, $\tau 0=8.46\times10^{-9}$,

Q=183200J,

R=8.314 J/K·mol,

εi0 represents a logarithmic strain at a reduction time, t represents a cumulative time period till immediately before the cooling in the pass, and T represents a rolling temperature in the pass.

When a finishing temperature of the rolling is set to less than $Ar_3$° C., the dislocation density of the austenite before transformation increases excessively, to thus make it difficult to set the crystal grains each having an intragranular misorientation of 5 to 14° to 20% or more. Therefore, the finishing temperature of the finish rolling is set to $Ar_3$° C. or more.

The finish rolling is preferably performed by using a tandem rolling mill in which a plurality of rolling mills are linearly arranged and that performs rolling continuously in one direction to obtain a desired thickness. Further, in the case where the finish rolling is performed using the tandem rolling mill, cooling (inter-stand cooling) is performed between the rolling mills to control the steel sheet temperature during the finish rolling to fall within a range of $Ar_3$° C. or more to $Ar_3$+150° C. or less. When the maximum temperature of the steel sheet during the finish rolling exceeds $Ar_3$+150° C., the grain size becomes too large, and thus deterioration in toughness is concerned.

The hot rolling is performed under such conditions as above, thereby making it possible to limit the dislocation density range of the austenite before transformation and obtain a desired proportion of the crystal grains each having an intragranular misorientation of 5 to 14°.

$Ar_3$ is calculated by Expression (3) below considering the effect on the transformation point by reduction based on the chemical composition of the steel sheet.

$$Ar_3=970-325\times[C]+33\times[Si]+287\times[P]+40\times[Al]-92\times([Mn]+[Mo]+[Cu])-46\times([Cr]+[Ni]) \quad (3)$$

Here, [C], [Si], [P], [Al], [Mn], [Mo], [Cu], [Cr], and [Ni] represent the contents of C, Si, P, Al, Mn, Mo, Cu, Cr, and Ni in mass % respectively. The elements that are not contained are calculated as 0%.

"First Cooling, Second Cooling"

In this manufacturing method, after the finish rolling is completed, the first cooling and the second cooling of the hot-rolled steel sheet are performed in this order. In the first cooling, the hot-rolled steel sheet is cooled down to a first temperature zone of 600 to 750° C. at a cooling rate of 10° C./s or more. In the second cooling, the hot-rolled steel sheet is cooled down to a second temperature zone of 450 to 630° C. at a cooling rate of 30° C./s or more. Between the first cooling and the second cooling, the hot-rolled steel sheet is retained in the first temperature zone for greater than 0 seconds and 10 seconds or less.

When the cooling rate of the first cooling is less than 10° C./s, the proportion of the crystal grains each having an intragranular crystal misorientation of 5 to 14° becomes short. Further, when a cooling stop temperature of the first cooling is less than 600° C., it becomes difficult to obtain 5% or more of ferrite by area ratio, and at the same time, the proportion of the crystal grains each having an intragranular crystal misorientation of 5 to 14° becomes short. Further, when the cooling stop temperature of the first cooling is greater than 750° C., it becomes difficult to obtain 40% or more of bainite by area ratio, and at the same time, the proportion of the crystal grains each having an intragranular crystal misorientation of 5 to 14° becomes short. From the viewpoint of obtaining a high bainite fraction, the cooling stop temperature of the first cooling is set to 750° C. or less, preferably set to 740° C. or less, more preferably set to 730° C. or less, and further preferably set to 720° C. or less.

When the retention time at 600 to 750° C. exceeds 10 seconds, cementite harmful to the burring property is likely to be generated. Further, when the retention time at 600 to 750° C. exceeds 10 seconds, it is often difficult to obtain 40% or more of bainite by area ratio, and further, the proportion of the crystal grains each having an intragranular crystal misorientation of 5 to 14° becomes short. From the viewpoint of obtaining a high bainite fraction, the retention time is set to 10.0 seconds or less, preferably set to 9.5 seconds or less, more preferably set to 9.0 seconds or less, and further preferably set to 8.5 seconds or less. When the retention time at 600 to 750° C. is 0 seconds, it becomes difficult to obtain 5% or more of ferrite by area ratio, and at the same time, the proportion of the crystal grains each having an intragranular crystal misorientation of 5 to 14° becomes short.

When the cooling rate of the second cooling is less than 30° C./s, cementite harmful to the burring property is likely to be generated, and at the same time, the proportion of the crystal grains each having an intragranular crystal misorientation of 5 to 14° becomes short. When a cooling stop temperature of the second cooling is less than 450° C., it becomes difficult to obtain 5% or more of ferrite by area ratio, and at the same time, the proportion of the crystal grains each having an intragranular crystal misorientation of 5 to 14° becomes short. On the other hand, when the cooling stop temperature of the second cooling is greater than 630° C., the proportion of the crystal grains each having an intragranular misorientation of 5 to 14° becomes short, and it becomes difficult to obtain 40% or more of bainite by area ratio in many cases. From the viewpoint of obtaining a high bainite fraction, the cooling stop temperature of the second cooling is set to 630° C. or less, preferably set to 610° C. or less, more preferably set to 590° C. or less, and further preferably set to 570° C. or less.

The upper limit of the cooling rate in each of the first cooling and the second cooling is not limited, in particular, but may be set to 200° C./s or less in consideration of the facility capacity of a cooling facility.

After the second cooling, the hot-rolled steel sheet is coiled. A coiling temperature is set to 630° C. or less, to thereby suppress precipitation of alloy carbonitrides at the steel sheet stage (stage from hot rolling till coiling).

As above, by highly controlling the hot-rolling heating, the cooling history, and further the coiling temperature, a desired hot-rolled original sheet can be achieved.

This hot-rolled original sheet has a structure containing, by area ratio, 5 to 60% of ferrite and 40 to 95% of bainite, and in the case where a region surrounded by a grain boundary having a misorientation of 15° C. or more and having a circle-equivalent diameter of 0.3 μm or more is defined as a crystal grain, the proportion of crystal grains each having an intragranular misorientation of 5 to 14° to all crystal grains is 20 to 100% by area ratio.

In this manufacturing method, the hot rolling conditions are controlled, to thereby introduce work dislocations into the austenite. Then, it is important to make the introduced work dislocations remain moderately by controlling the cooling conditions. That is, even when the hot rolling conditions or the cooling conditions are controlled independently, it is impossible to obtain a desired hot-rolled original sheet, resulting in that it is important to appropriately control both of the hot rolling conditions and the cooling conditions. The conditions other than the above are not limited in particular because well-known methods such as coiling by a well-known method after the second cooling, for example, only need to be used.

"First Skin Pass Rolling"

In the first skin pass rolling, the hot-rolled steel sheet is pickled, and on the pickled steel sheet, skin pass rolling is performed at an elongation percentage of 0.1 to 5.0%. The skin pass rolling is performed on the steel sheet, thereby making it possible to provide strains to the surface of the steel sheet. During annealing in a subsequent step, nuclei of alloy carbonitrides are more likely to be formed on the dislocation via the strain, and thereby, the surface layer is hardened. When the elongation percentage of the skin pass rolling is less than 0.1%, it is impossible to provide sufficient strains and the surface layer hardness Hvs does not increase. On the other hand, when the elongation percentage of the skin pass rolling exceeds 5.0%, strains are provided not only to the surface layer, but also to the center portion of the steel sheet, and thus the workability of the steel sheet deteriorates. In a normal steel sheet, ferrite is recrystallized by the subsequent annealing, and thereby, the elongation and the hole expandability improve. However, in the hot-rolled steel sheet that has the chemical composition in this embodiment and is coiled at 630° C. or less, Ti, Nb, Mo, and V are solid-dissolved, and these significantly delay the recrystallization of ferrite by the annealing, resulting in that the elongation and the hole expandability after the annealing do not improve. Therefore, the elongation percentage of the skin pass rolling is set to 5.0% or less. The strain is provided according to the elongation percentage of this skin pass rolling, and from the viewpoint of improvement in fatigue property, the precipitation strengthening near the surface layer of the steel sheet progresses during annealing according to the amount of strain in the surface layer of the steel sheet. Therefore, the elongation percentage is preferably set to 0.4% or more. Further, from the viewpoint of workability of the steel sheet, the elongation percentage is preferably set to 2.0% or less in order to prevent deterioration of the workability caused by the strains provided in the steel sheet. The case where the elongation percentage of the skin pass rolling is 0.1 to 5.0% reveals that Hvs/Hvc improves to be 0.85 or more. Further, the case where the skin pass rolling is not performed (the elongation percentage of the skin pass rolling is 0%) or the elongation percentage of the skin pass rolling exceeds greater than 5.0% reveals that Hvs/Hvc<0.85 is established.

When the elongation percentage of the first skin pass rolling is 0.1 to 5.0%, excellent elongation is obtained. Further, when the elongation percentage of the first skin pass rolling exceeds 5.0%, the elongation deteriorates and the press formability deteriorates. When the elongation percentage of the first skin pass rolling exceeds 0% or 5%, the fatigue strength ratio deteriorates.

The case where the elongation percentage of the first skin pass rolling is 0.1 to 5.0% reveals that substantially the same elongation and fatigue strength ratio are obtained as long as the tensile strengths are substantially the same. The case where the elongation percentage of the first skin pass rolling exceeds 5% (high skin pass region) reveals that the elongation is low and further the fatigue strength ratio is also low even when the tensile strength is 490 MPa or more.

"Annealing"

After the first skin pass rolling is performed, the steel sheet is annealed. Incidentally, a leveler or the like may be used for the purpose of shape correction. The purpose of performing annealing is not to perform tempering of a hard phase, but to precipitate Ti, Nb, Mo, and V, which are solid-dissolved in the steel sheet, as alloy carbonitrides. Thus, it becomes important to control a maximum heating temperature (Tmax) and a retention time in an annealing step. The maximum heating temperature and the retention time are each controlled to fall within a predetermined range, thereby increasing the tensile strength and the yield stress and further improving the hardness of the surface layer, resulting in that improvement of the fatigue property and the crashworthiness is performed. When the temperature and the retention time during annealing are inappropriate, carbonitrides do not precipitate or coarsening of precipitated carbonitrides occurs, and thus the maximum heating temperature and the retention time are limited as follows.

The maximum heating temperature during annealing is set to fall within a range of 600 to 750° C. When the maximum heating temperature is less than 600° C., the time required for the precipitation of alloy carbonitrides becomes extremely long to make manufacture in a continuous annealing line difficult. Therefore, the maximum heating temperature is set to 600° C. or more. Further, when the maximum heating temperature is greater than 750° C., coarsening of alloy carbonitrides occurs and it is impossible to sufficiently obtain the increase in strength by precipitation strengthening. Further, when the maximum heating temperature is the Ac1 point or more, a two-phase region of ferrite and austenite is made, thereby making it impossible to sufficiently obtain the increase in strength by precipitation strengthening. Therefore, the maximum heating temperature is set to 750° C. or less. As above, the main purpose of this annealing is not to perform tempering of a hard phase, but to precipitate Ti and Nb, which are solid-dissolved in the steel sheet. On this occasion, the final strength is determined by alloy components of a steel product or the fraction of each phase in the microstructure of the steel sheet, but the improvement of the fatigue property by hardening of the surface layer and the improvement of the yield ratio are not affected by the alloy components of the steel product or the fraction of each phase in the microstructure of the steel sheet at all.

As a result that the present inventors intensively conducted experiments, they found out that the retention time (t) at 600° C. or more during annealing satisfies the relationship of Expressions (4) and (5) below in response to the maximum heating temperature (Tmax) during annealing, thereby making it possible to satisfy a high yield stress and Hvs/Hvc of 0.85 or more.

$$530-0.7\times T\max \leq t \leq 3600-3.9\times T\max \quad (4)$$

$$t>0 \quad (5)$$

When the maximum heating temperature is in a range of 600 to 750° C., Hvs/Hvc becomes 0.85 or more. The steel sheet according to this embodiment is manufactured under the condition that the retention time (t) at 600° C. or more satisfies the ranges of Expressions (4) and (5). In the steel sheet according to this embodiment, when the retention time (t) satisfies the ranges of Expressions (4) and (5), Hvs/Hvc becomes 0.85 or more. In the steel sheet according to this embodiment, when Hvs/Hvc is 0.85 or more, the fatigue strength ratio becomes 0.45 or more. When the maximum heating temperature is in a range of 600 to 750° C., the surface layer is hardened by precipitation strengthening and Hvs/Hvc becomes 0.85 or more. The maximum heating temperature and the retention time at 600° C. or more are set to fall within the above-described ranges, and thereby the surface layer is hardened sufficiently as compared to the hardness of the center portion of the steel sheet. Thereby, the fatigue strength ratio becomes 0.45 or more in the steel sheet according to this embodiment. This is because hardening of the surface layer makes it possible to delay occurrence of fatigue cracks, and as the hardness of the surface layer is higher, the effect becomes larger.

"Second Skin Pass Rolling"

After the annealing, the second skin pass rolling is performed on the steel sheet. This makes it possible to further improve the fatigue property. In the second skin pass rolling, the elongation percentage is set to 0.2 to 2.0% and preferably set to 0.5 to 1.0%. When the elongation percentage is less than 0.2%, it is impossible to obtain sufficient improvement of surface roughness and work hardening of only the surface layer, resulting in that the fatigue property does not improve sufficiently in some cases. Therefore, the elongation percentage of the second skin pass rolling is set to 0.2% or more. On the other hand, when the elongation percentage exceeds 2.0%, the steel sheet work-hardens too much, resulting in that the press formability deteriorates in some cases. Therefore, the elongation percentage of the second skin pass rolling is set to 2.0% or less.

In this manner, it is possible to obtain the steel sheet according to this embodiment. That is, the chemical composition containing the alloying elements and the manufacturing conditions are controlled minutely, thereby making it possible to manufacture a high-strength steel sheet that has excellent formability, fatigue property, and collision safety, which have not been able to be achieved conventionally, and has a tensile strength of 480 MPa or more.

Note that the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLES

Next, examples of the present invention will be explained. Conditions in the examples are examples of conditions employed to verify feasibility and effects of the present invention, and the present invention is not limited to the examples of conditions. The present invention can employ various conditions without departing from the spirit of the present invention to the extent to achieve the objects of the present invention.

Steels having chemical compositions illustrated in Table 1 and Table 2 were smelted to manufacture steel billets, the obtained steel billets were heated to heating temperatures illustrated in Table 3 and Table 4 to be subjected to rough rolling, and then subjected to finish rolling under conditions illustrated in Table 3 and Table 4. Sheet thicknesses of hot-rolled steel sheets after the finish rolling were 2.2 to 3.4 mm. Each blank column in Table 2 indicates that an analysis value was less than a detection limit. Each underline in Table 1 and Table 2 indicates that a numerical value thereof is out of the range of the present invention, and each underline in Table 4 indicates that a numerical value thereof is out of the range suitable for the manufacture of the steel sheet of the present invention.

TABLE 1

| STEEL | CHEMICAL COMPOSITION (MASS %, BALANCE: Fe AND IMPURITIES) | | | | | | | | |
|---|---|---|---|---|---|---|---|---|---|
| No. | C | Si | Mn | P | S | Al | Ti | Nb | N |
| A | 0.047 | 0.41 | 0.72 | 0.011 | 0.005 | 0.050 | 0.150 | 0.031 | 0.0026 |
| B | 0.036 | 0.32 | 1.02 | 0.019 | 0.003 | 0.030 | 0.090 | 0.022 | 0.0019 |
| C | 0.070 | 1.22 | 1.21 | 0.022 | 0.006 | 0.040 | 0.110 | 0.042 | 0.0034 |
| D | 0.053 | 0.81 | 1.51 | 0.016 | 0.012 | 0.030 | 0.110 | 0.033 | 0.0027 |
| E | 0.039 | 0.21 | 1.01 | 0.014 | 0.008 | 0.040 | 0.040 | 0.022 | 0.0029 |
| F | 0.041 | 0.93 | 1.23 | 0.014 | 0.010 | 0.030 | 0.150 | 0.037 | 0.0034 |
| G | 0.064 | 0.72 | 1.21 | 0.014 | 0.009 | 0.100 | 0.120 | 0.031 | 0.0043 |
| H | 0.051 | 0.53 | 1.33 | 0.016 | 0.008 | 0.030 | 0.140 | 0.041 | 0.0027 |
| I | 0.059 | 0.62 | 1.02 | 0.010 | 0.010 | 0.080 | 0.110 | 0.023 | 0.0021 |
| J | 0.031 | 0.62 | 0.73 | 0.013 | 0.006 | 0.030 | 0.110 | 0.022 | 0.0027 |
| K | 0.043 | 1.42 | 1.72 | 0.011 | 0.003 | 0.050 | 0.150 | 0.032 | 0.0035 |
| L | 0.054 | 0.43 | 1.52 | 0.014 | 0.005 | 0.040 | 0.130 | 0.041 | 0.0023 |
| M | 0.056 | 0.22 | 1.23 | 0.016 | 0.008 | 0.030 | 0.160 | 0.021 | 0.0011 |
| N | 0.066 | 0.81 | 1.41 | 0.015 | 0.007 | 0.050 | 0.090 | 0.017 | 0.0021 |
| O | 0.061 | 0.61 | 1.62 | 0.018 | 0.009 | 0.040 | 0.120 | 0.023 | 0.0027 |
| P | 0.052 | 0.81 | 1.82 | 0.015 | 0.010 | 0.030 | 0.100 | 0.033 | 0.0027 |
| Q | 0.039 | 0.13 | 1.41 | 0.010 | 0.008 | 0.200 | 0.070 | 0.012 | 0.0027 |
| R | 0.026 | 0.05 | 1.16 | 0.011 | 0.004 | 0.015 | 0.070 | 0.000 | 0.0029 |
| S | 0.092 | 0.05 | 1.20 | 0.002 | 0.003 | 0.030 | 0.015 | 0.029 | 0.0030 |
| T | 0.062 | 0.06 | 1.48 | 0.017 | 0.003 | 0.035 | 0.055 | 0.035 | 0.0031 |
| U | 0.081 | 0.04 | 1.52 | 0.014 | 0.004 | 0.030 | 0.022 | 0.020 | 0.0034 |
| a | 0.162 | 0.42 | 1.22 | 0.010 | 0.006 | 0.300 | 0.080 | 0.043 | 0.0015 |
| b | 0.051 | 2.73 | 0.82 | 0.012 | 0.010 | 0.050 | 0.090 | 0.032 | 0.0024 |
| c | 0.047 | 0.23 | 3.21 | 0.015 | 0.008 | 0.040 | 0.080 | 0.041 | 0.0030 |
| d | 0.007 | 0.52 | 0.82 | 0.013 | 0.007 | 0.030 | 0.050 | 0.002 | 0.0043 |
| e | 0.064 | 0.62 | 1.72 | 0.016 | 0.012 | 0.030 | 0.250 | 0.032 | 0.0021 |
| g | 0.049 | 0.52 | 1.22 | 0.018 | 0.009 | 0.060 | 0.150 | 0.081 | 0.0027 |

TABLE 2

| STEEL | CHEMICAL COMPOSITION (MASS %, BALANCE: Fe AND IMPURITIES) | | | | | | | | | | Ar3 |
|---|---|---|---|---|---|---|---|---|---|---|---|
| No. | Cr | B | Mo | Cu | Ni | Mg | REM | Ca | Zr | Ti + Nb | (° C.) |
| A | | | | | | | | | | 0.181 | 907 |
| B | | | | | | | | | | 0.112 | 882 |
| C | | | | | | | | 0.001 | | 0.152 | 884 |
| D | 0.15 | | | | | | | | | 0.143 | 839 |
| E | | | | | | | | | | 0.062 | 870 |
| F | | | | | | | | | | 0.187 | 880 |
| G | | 0.0010 | | | | | | | | 0.151 | 870 |
| H | | | | | | | | | | 0.181 | 855 |
| I | | | | 0.06 | 0.03 | | | | 0.001 | 0.133 | 877 |
| J | | | | | | | | | | 0.132 | 918 |
| K | | | 0.13 | | | | | | | 0.182 | 838 |
| L | | | | | | | 0.005 | | | 0.171 | 832 |
| M | | | | 0.08 | 0.04 | | | | | 0.181 | 842 |
| N | | | | | | | | | | 0.107 | 852 |
| O | | | | | | 0.0003 | | | | 0.143 | 828 |
| P | | | | | | | | | | 0.133 | 818 |
| Q | | | | | | | | | | 0.082 | 843 |
| R | | | | | | | | | | 0.070 | 860 |
| S | | | | | | | | | | 0.044 | 833 |
| T | | | | | | | | | | 0.090 | 822 |
| U | | | | | | | | | | 0.042 | 811 |
| a | | | | | | | | | | 0.123 | 834 |
| b | | | | | | | | 0.0006 | | 0.122 | 974 |
| c | | | | | | | | | | 0.121 | 673 |

TABLE 2-continued

| STEEL | CHEMICAL COMPOSITION (MASS %, BALANCE: Fe AND IMPURITIES) | | | | | | | | | | Ar3 |
|---|---|---|---|---|---|---|---|---|---|---|---|
| No. | Cr | B | Mo | Cu | Ni | Mg | REM | Ca | Zr | Ti + Nb | (° C.) |
| d | | 0.0030 | | | | | | | | 0.007 | 914 |
| e | | | | | | | | | | 0.282 | 817 |
| g | | | | | | | | | | 0.231 | 867 |

TABLE 3

| TEST No. | STEEL No. | Ar3 (° C.) | SRT min (° C.) | HEATING TEMPERATURE (° C.) | FINISH ROLLING FINISHING TEMPERATURE (° C.) | CUMULATIVE STRAIN AT FINAL THREE STAGES OF FINISH ROLLING | MAXIMUM TEMPERATURE OF STEEL SHEET AT FINISH ROLLING TIME (° C.) |
|---|---|---|---|---|---|---|---|
| 1 | A | 907 | 1141 | 1200 | 913 | 0.55 | 1030 |
| 2 | B | 882 | 1071 | 1180 | 900 | 0.58 | 1010 |
| 3 | C | 884 | 1179 | 1220 | 902 | 0.56 | 1000 |
| 4 | D | 839 | 1139 | 1200 | 880 | 0.55 | 980 |
| 5 | E | 870 | 1035 | 1180 | 900 | 0.52 | 1000 |
| 6 | F | 880 | 1135 | 1200 | 920 | 0.53 | 1020 |
| 7 | G | 870 | 1162 | 1180 | 892 | 0.54 | 990 |
| 8 | H | 855 | 1158 | 1230 | 910 | 0.59 | 1000 |
| 9 | I | 877 | 1134 | 1210 | 893 | 0.56 | 1005 |
| 10 | J | 918 | 1067 | 1230 | 930 | 0.57 | 1020 |
| 11 | K | 838 | 1135 | 1200 | 889 | 0.51 | 970 |
| 12 | L | 832 | 1161 | 1200 | 920 | 0.56 | 970 |
| 13 | M | 842 | 1149 | 1230 | 902 | 0.54 | 970 |
| 14 | N | 852 | 1120 | 1180 | 880 | 0.53 | 980 |
| 15 | O | 828 | 1143 | 1200 | 889 | 0.58 | 970 |
| 16 | P | 818 | 1131 | 1180 | 870 | 0.58 | 960 |
| 17 | Q | 843 | 1041 | 1200 | 908 | 0.59 | 987 |
| 18 | R | 860 | 1000 | 1240 | 920 | 0.54 | 960 |
| 19 | S | 833 | 1079 | 1240 | 910 | 0.53 | 930 |
| 20 | T | 822 | 1117 | 1240 | 940 | 0.58 | 950 |
| 21 | U | 811 | 1069 | 1240 | 910 | 0.58 | 950 |

TABLE 4

| TEST No. | STEEL No. | Ar3 (° C.) | SRT min (° C.) | HEATING TEMPERATURE (° C.) | FINISH ROLLING FINISHING TEMPERATURE (° C.) | CUMULATIVE STRAIN AT FINAL THREE STAGES OF FINISH ROLLING | MAXIMUM TEMPERATURE OF STEEL SHEET AT FINISH ROLLING TIME (° C.) |
|---|---|---|---|---|---|---|---|
| 22 | a | 834 | 1257 | 1210 | 890 | 0.55 | 990 |
| 23 | b | 974 | 1120 | 1180 | 982 | 0.56 | 1079 |
| 24 | c | 673 | 1116 | 1200 | 760 | 0.57 | 820 |
| 25 | d | 914 | 838 | 1200 | 908 | 0.55 | 990 |
| 26 | e | 817 | 1212 | 1270 | 870 | 0.54 | 960 |
| 27 | g | 867 | 1191 | 1210 | 900 | 0.55 | 980 |
| 28 | M | 842 | 1149 | 1130 | 900 | 0.54 | 980 |
| 29 | C | 884 | 1179 | 1180 | 850 | 0.52 | 1010 |
| 30 | C | 884 | 1179 | 1200 | 892 | 0.44 | 1010 |
| 31 | C | 884 | 1179 | 1200 | 903 | 0.69 | 1010 |
| 32 | C | 884 | 1179 | 1210 | 950 | 0.58 | 1050 |
| 33 | C | 884 | 1179 | 1200 | 902 | 0.59 | 1000 |
| 34 | C | 884 | 1179 | 1190 | 920 | 0.56 | 1010 |
| 35 | M | 842 | 1149 | 1200 | 900 | 0.53 | 990 |
| 36 | M | 842 | 1149 | 1180 | 889 | 0.54 | 980 |
| 37 | M | 842 | 1149 | 1200 | 890 | 0.55 | 990 |
| 38 | M | 842 | 1149 | 1200 | 895 | 0.56 | 985 |
| 39 | M | 842 | 1149 | 1210 | 902 | 0.57 | 990 |
| 40 | M | 842 | 1149 | 1210 | 900 | 0.52 | 980 |
| 41 | M | 842 | 1149 | 1230 | 902 | 0.54 | 970 |
| 42 | M | 842 | 1149 | 1230 | 902 | 0.54 | 970 |
| 43 | M | 842 | 1149 | 1230 | 902 | 0.54 | 970 |
| 44 | M | 842 | 1149 | 1230 | 902 | 0.54 | 970 |

TABLE 4-continued

| TEST No. | STEEL No. | Ar3 (° C.) | SRT min (° C.) | HEATING TEMPERATURE (° C.) | FINISH ROLLING FINISHING TEMPERATURE (° C.) | CUMULATIVE STRAIN AT FINAL THREE STAGES OF FINISH ROLLING | MAXIMUM TEMPERATURE OF STEEL SHEET AT FINISH ROLLING TIME (° C.) |
|---|---|---|---|---|---|---|---|
| 45 | M | 842 | 1149 | 1230 | 902 | 0.54 | 970 |
| 46 | M | 842 | 1149 | 1230 | 902 | 0.54 | 970 |

$Ar_3$ (° C.) was obtained from the components illustrated in Table 1 and Table 2 by using Expression (3).

$$Ar_3=970-325\times[C]+33\times[Si]+287\times[P]+40\times[Al]-92\times([Mn]+[Mo]+[Cu])-46\times([Cr]+[Ni]) \quad (3)$$

The cumulative strain at the final three stages was obtained by Expression (2)

$$\varepsilon eff.=\Sigma\varepsilon i(t,T) \quad (2)$$

Here, $\varepsilon i(t,T)=\varepsilon i0/\exp\{(t/\tau R)^{2/3}\}$, $\tau R=\tau 0\cdot\exp(Q/RT)$, $\tau 0=8.46\times10^{-9}$,

Q=183200 J,

R=8.314 J/K·mol,

εi0 represents a logarithmic strain at a reduction time, t represents a cumulative time period till immediately before the cooling in the pass, and T represents a rolling temperature in the pass.

Next, under conditions illustrated in Table 5 and Table 6, of the hot-rolled steel sheets, first cooling, retention in a first temperature zone, second cooling, first skin pass rolling, annealing, and second skin pass rolling were performed, and hot-rolled steel sheets of Test No. 1 to 46 were obtained. A temperature increasing rate of the annealing was set to 5° C./s and a cooling rate from the maximum heating temperature was set to 5° C./s. Further, in some of experimental examples, subsequent to the annealing, hot-dip galvanizing and an alloying treatment were performed to manufacture hot-dip galvanized steel sheets (described as GI) and alloyed hot-dip galvanized steel sheets (described as GA). Incidentally, in the case of manufacturing the hot-dip galvanized steel sheet, the second skin pass rolling was performed after the hot-dip galvanizing, and in the case of manufacturing the alloyed hot-dip galvanized steel sheet, the second skin pass was performed after the alloying treatment. Each underline in Table 6 indicates that a numerical value thereof is out of the range suitable for the manufacture of the steel sheet of the present invention.

TABLE 5

| TEST No. | STEEL No. | COOLING RATE OF FIRST COOLING (° C./s) | COOLING STOP TEMPERATURE OF FIRST COOLING (° C.) | RETENTION TIME IN FIRST TEMPERATURE ZONE (SECOND) | COOLING RATE OF SECOND COOLING (° C./s) | COOLING STOP TEMPERATURE OF SECOND COOLING (° C.) | ELONGATION PERCENTAGE OF FIRST SKIN PASS ROLLING (%) |
|---|---|---|---|---|---|---|---|
| 1 | A | 15 | 690 | 3 | 35 | 570 | 0.3 |
| 2 | B | 20 | 650 | 4 | 40 | 570 | 0.4 |
| 3 | C | 30 | 610 | 2 | 45 | 600 | 0.6 |
| 4 | D | 35 | 630 | 5 | 35 | 620 | 0.2 |
| 5 | E | 30 | 650 | 3 | 40 | 590 | 0.4 |
| 6 | F | 20 | 630 | 4 | 50 | 530 | 0.2 |
| 7 | G | 35 | 660 | 6 | 33 | 510 | 0.3 |
| 8 | H | 20 | 670 | 3 | 40 | 570 | 0.4 |
| 9 | I | 40 | 610 | 2 | 35 | 570 | 0.5 |
| 10 | J | 27 | 680 | 4 | 40 | 600 | 0.2 |
| 11 | K | 16 | 690 | 8 | 36 | 640 | 0.2 |
| 12 | L | 55 | 650 | 3 | 60 | 570 | 0.3 |
| 13 | M | 48 | 640 | 2 | 54 | 550 | 0.3 |
| 14 | N | 45 | 650 | 4 | 65 | 530 | 0.2 |
| 15 | O | 40 | 660 | 6 | 36 | 540 | 0.4 |
| 16 | P | 15 | 630 | 5 | 55 | 580 | 0.4 |
| 17 | Q | 23 | 680 | 5 | 49 | 620 | 0.4 |
| 18 | R | 49 | 660 | 3 | 30 | 600 | 0.5 |
| 19 | S | 50 | 660 | 3 | 30 | 630 | 0.2 |
| 20 | T | 50 | 620 | 3 | 30 | 600 | 0.2 |
| 21 | U | 60 | 610 | 3 | 30 | 550 | 0.4 |

| TEST No. | STEEL No. | MAXIMUM HEATING TEMPERATURE OF ANNEALING (° C.) | RETENTION TIME OF ANNEALING (SECOND) | LEFT SIDE OF EXPRESSION (4) (° C.) | RIGHT SIDE OF EXPRESSION (4) (° C.) | PLATING | ELONGATION PERCENTAGE OF SECOND SKIN PASS ROLLING (%) |
|---|---|---|---|---|---|---|---|
| 1 | A | 640 | 140 | 82 | 1104 | GI | 0.7 |
| 2 | B | 690 | 210 | 47 | 909 | GI | 0.2 |
| 3 | C | 690 | 170 | 47 | 909 | GI | 0.3 |

TABLE 5-continued

| | | | | | | | |
|---|---|---|---|---|---|---|---|
| 4 | D | 640 | 180 | 82 | 1104 | GI | 0.5 |
| 5 | E | 640 | 190 | 82 | 1104 | GI | 0.7 |
| 6 | F | 680 | 150 | 54 | 948 | GI | 0.5 |
| 7 | G | 640 | 240 | 82 | 1104 | GI | 0.3 |
| 8 | H | 630 | 150 | 89 | 1143 | GI | 0.3 |
| 9 | I | 650 | 150 | 75 | 1065 | GI | 0.3 |
| 10 | J | 670 | 190 | 61 | 987 | GA | 0.6 |
| 11 | K | 640 | 190 | 82 | 1104 | GA | 0.2 |
| 12 | L | 630 | 230 | 89 | 1143 | GA | 0.2 |
| 13 | M | 640 | 140 | 82 | 1104 | GA | 0.2 |
| 14 | N | 640 | 130 | 82 | 1104 | NONE | 0.2 |
| 15 | O | 630 | 210 | 89 | 1143 | NONE | 0.2 |
| 16 | P | 640 | 120 | 82 | 1104 | NONE | 0.2 |
| 17 | Q | 630 | 210 | 89 | 1143 | GA | 0.6 |
| 18 | R | 700 | 170 | 40 | 870 | GI | 0.2 |
| 19 | S | 700 | 180 | 40 | 870 | GI | 0.2 |
| 20 | T | 700 | 190 | 40 | 870 | GI | 0.2 |
| 21 | U | 750 | 180 | 5 | 675 | GA | 0.5 |

TABLE 6

| TEST No. | STEEL No. | COOLING RATE OF FIRST COOLING (° C./s) | COOLING STOP TEMPERATURE OF FIRST COOLING (° C.) | RETENTION TIME IN FIRST TEMPERATURE ZONE (SECOND) | COOLING RATE OF SECOND COOLING (° C./s) | COOLING STOP TEMPERATURE OF SECOND COOLING (° C.) | ELONGATION PERCENTAGE OF FIRST SKIN PASS ROLLING (%) |
|---|---|---|---|---|---|---|---|
| 22 | a | 30 | 690 | 4 | 35 | 600 | 0.3 |
| 23 | b | 25 | 690 | 5 | 45 | 570 | 0.3 |
| 24 | c | 43 | 700 | 6 | 37 | 560 | 0.5 |
| 25 | d | 18 | 670 | 2 | 42 | 550 | 0.2 |
| 26 | e | 32 | 640 | 3 | 53 | 540 | 0.2 |
| 27 | g | 45 | 710 | 4 | 46 | 650 | 0.4 |
| 28 | M | 30 | 690 | 4 | 35 | 570 | 0.7 |
| 29 | C | 15 | 740 | 3 | 50 | 590 | 0.6 |
| 30 | C | 24 | 720 | 6 | 43 | 600 | 0.3 |
| 31 | C | 43 | 710 | 3 | 54 | 570 | 0.5 |
| 32 | C | 35 | 720 | 3 | 43 | 550 | 0.2 |
| 33 | C | 5 | 680 | 8 | 25 | 580 | 0.3 |
| 34 | C | 23 | 450 | 4 | 36 | 440 | 0.6 |
| 35 | M | 45 | 795 | 5 | 35 | 620 | 03 |
| 36 | M | 20 | 710 | 0 | 48 | 560 | 0.5 |
| 37 | M | 12 | 650 | 15 | 45 | 550 | 0.2 |
| 38 | M | 12 | 700 | 4 | 5 | 570 | 0.2 |
| 39 | M | 32 | 600 | 5 | 43 | 360 | 0.2 |
| 40 | M | 29 | 700 | 3 | 35 | 670 | 0.5 |
| 41 | M | 48 | 640 | 2 | 54 | 550 | 0 |
| 42 | M | 48 | 640 | 2 | 54 | 550 | 6 |
| 43 | M | 48 | 640 | 2 | 54 | 550 | 0.6 |
| 44 | M | 48 | 640 | 2 | 54 | 550 | 0.6 |
| 45 | M | 48 | 640 | 2 | 54 | 550 | 0.5 |
| 46 | M | 48 | 640 | 2 | 54 | 550 | 0.7 |

| TEST No. | STEEL No. | MAXIMUM HEATING TEMPERATURE OF ANNEALING (° C.) | RETENTION TIME OF ANNEALING (SECOND) | LEFT SIDE OF EXPRESSION (4) (° C.) | RIGHT SIDE OF EXPRESSION (4) (° C.) | PLATING | ELONGATION PERCENTAGE OF SECOND SKIN PASS ROLLING (%) |
|---|---|---|---|---|---|---|---|
| 22 | a | 680 | 230 | 54 | 948 | GI | 0.6 |
| 23 | b | 650 | 220 | 75 | 1065 | GI | 0.5 |
| 24 | c | 640 | 170 | 82 | 1104 | GI | 0.4 |
| 25 | d | 650 | 120 | 75 | 1065 | GI | 0.2 |
| 26 | e | 690 | 120 | 47 | 909 | GI | 0.6 |
| 27 | g | 650 | 170 | 75 | 1065 | GI | 0.4 |
| 28 | M | 680 | 180 | 54 | 948 | GI | 0.5 |
| 29 | C | 680 | 240 | 54 | 948 | GI | 0.5 |
| 30 | C | 680 | 130 | 54 | 948 | GI | 0.3 |
| 31 | C | 630 | 130 | 89 | 1143 | GI | 0.5 |
| 32 | C | 690 | 160 | 47 | 909 | GI | 0.2 |
| 33 | C | 680 | 150 | 54 | 948 | GI | 0.4 |
| 34 | C | 640 | 180 | 82 | 1104 | GI | 0.3 |
| 35 | M | 660 | 160 | 68 | 1026 | GI | 0.5 |
| 36 | M | 670 | 220 | 61 | 987 | GI | 0.6 |

TABLE 6-continued

| | | | | | | | |
|---|---|---|---|---|---|---|---|
| 37 | M | 680 | 140 | 54 | 948 | GI | 0.6 |
| 38 | M | 650 | 230 | 75 | 1065 | GI | 0.6 |
| 39 | M | 680 | 240 | 54 | 948 | GI | 0.7 |
| 40 | M | 640 | 120 | 82 | 1104 | GI | 0.4 |
| 41 | M | 650 | 200 | 75 | 1065 | GI | 0.1 |
| 42 | M | 670 | 170 | 61 | 987 | GI | 0.4 |
| 43 | M | 790 | 150 | −23 | 519 | GI | 0.1 |
| 44 | M | 520 | 240 | 166 | 1572 | GI | 0.2 |
| 45 | M | 680 | 10 | 54 | 948 | GI | 0.5 |
| 46 | M | 660 | 1500 | 68 | 1026 | GI | 0.4 |

Then, of each of the steel sheets, structural fractions (area ratios) of ferrite, bainite, martensite, and pearlite, a proportion of crystal grains each having an intragranular misorientation of 5 to 14°, a precipitate density, and a dislocation density were obtained by the following methods. Results thereof are illustrated in Table 7 and Table 8. The case where martensite and/or pearlite are/is contained was described in the column of "BALANCE STRUCTURE" in the table. Each underline in Table 8 indicates that a numerical value thereof is out of the range of the present invention.

"Structural Fractions (Area Ratios) of Ferrite, Bainite, Martensite, and Pearlite"

First, a sample collected from the steel sheet was etched by nital. After the etching, a structure photograph obtained at a ¼ depth position of the sheet thickness in a visual field of 300 μm×300 μm was subjected to an image analysis by using an optical microscope. By this image analysis, the area ratio of ferrite, the area ratio of pearlite, and the total area ratio of bainite and martensite were obtained. Next, a sample etched by LePera was used, and a structure photograph obtained at a ¼ depth position of the sheet thickness in a visual field of 300 μm×300 μm was subjected to an image analysis by using an optical microscope. By this image analysis, the total area ratio of retained austenite and martensite was obtained. Further, a sample obtained by grinding the surface to a depth of ¼ of the sheet thickness from a direction normal to a rolled surface was used, and the volume fraction of the retained austenite was obtained through an X-ray diffraction measurement. The volume fraction of the retained austenite was equivalent to the area ratio, and thus was set as the area ratio of the retained austenite. Then, the area ratio of martensite was obtained by subtracting the area ratio of the retained austenite from the total area ratio of the retained austenite and the martensite, and the area ratio of bainite was obtained by subtracting the area ratio of the martensite from the total area ratio of the bainite and the martensite. In this manner, the area ratio of each of ferrite, bainite, martensite, retained austenite, and pearlite was obtained.

"Proportion of crystal grains each having an intragranular misorientation of 5 to 14°"

At a ¼ depth position of a sheet thickness t from the surface of the steel sheet (¼ t portion) in a cross section vertical to a rolling direction, a region of 200 μm in the rolling direction and 100 μm in a direction normal to the rolled surface was subjected to an EBSD analysis at a measurement pitch of 0.2 μm to obtain crystal orientation information. Here, the EBSD analysis was performed by using an apparatus composed of a thermal field emission scanning electron microscope (JSM-7001F manufactured by JEOL Ltd.) and an EBSD detector (HIKARI detector manufactured by TSL Co., Ltd.), at an analysis speed of 200 to 300 points/second. Next, with respect to the obtained crystal orientation information, a region having a misorientation of 15° or more and a circle-equivalent diameter of 0.3 μm or more was defined as a crystal grain, the average intragranular misorientation of crystal grains was calculated, and the proportion of the crystal grains each having an intragranular misorientation of 5 to 14° was obtained. The crystal grain defined as described above and the average intragranular misorientation were calculated by using software "OIM Analysis (registered trademark)" attached to an EBSD analyzer.

"Precipitate Density"

Precipitates were observed by observing a replica sample fabricated according to a method described in Japanese Laid-open Patent Publication No. 2004-317203 by a transmission electron microscope. The visual fields were set at 5000-fold to 100000-fold magnification, and the number of Ti(C,N) and Nb(C,N) each having 10 nm or less was counted from 3 or more visual fields. Then, an electrolytic weight was obtained from a change in weight before and after electrolysis, and the weight was converted into a volume by a specific gravity of 7.8 ton/$m^3$, the counted number was divided by the volume, and thereby, the total precipitate density was calculated.

"Dislocation Density"

The dislocation density was measured according to "Method of evaluating a dislocation density using X-ray diffraction" described in CAMP-ISIJ Vol. 17 (2004) p. 396, and the average dislocation density was calculated from full widths at half maximum of (110), (211), and (220).

TABLE 7

| TEST No. | FERRITE AREA RATIO (%) | BAINITE AREA RATIO (%) | BALANCE STRUCTURE (%) | PROPORTION OF CRYSTAL GRAINS EACH HAVING INTRAGRANULAR MISORIENTATION OF 5 TO 14° (%) | SURFACE LAYER HARDNESS Hvs | CENTER HARDNESS Hvc | HARDNESS RATIO | PRECIPITATE DENSITY (PRECIPITATE/mm$^2$) | DISLOCATION DENSITY (/m$^2$) | NOTE |
|---|---|---|---|---|---|---|---|---|---|---|
| 1 | 24 | 76 | 0 | 40 | 192 | 206 | 0.93 | $5 \times 10^{11}$ | $3 \times 10^{13}$ | PRESENT INVENTION EXAMPLE |
| 2 | 31 | 69 | 0 | 74 | 175 | 190 | 0.92 | $3 \times 10^{11}$ | $4 \times 10^{13}$ | PRESENT INVENTION EXAMPLE |
| 3 | 15 | 85 | 0 | 53 | 228 | 253 | 0.90 | $2 \times 10^{11}$ | $5 \times 10^{13}$ | PRESENT INVENTION EXAMPLE |
| 4 | 25 | 75 | 0 | 69 | 226 | 246 | 0.92 | $5 \times 10^{11}$ | $2 \times 10^{13}$ | PRESENT INVENTION EXAMPLE |
| 5 | 48 | 52 | 0 | 26 | 173 | 189 | 0.92 | $4 \times 10^{11}$ | $2 \times 10^{13}$ | PRESENT INVENTION EXAMPLE |
| 6 | 25 | 75 | 0 | 33 | 235 | 250 | 0.94 | $5 \times 10^{11}$ | $5 \times 10^{13}$ | PRESENT INVENTION EXAMPLE |
| 7 | 23 | 77 | 0 | 50 | 202 | 224 | 0.90 | $4 \times 10^{11}$ | $2 \times 10^{13}$ | PRESENT INVENTION EXAMPLE |
| 8 | 30 | 70 | 0 | 81 | 216 | 243 | 0.89 | $3 \times 10^{11}$ | $4 \times 10^{13}$ | PRESENT INVENTION EXAMPLE |
| 9 | 55 | 45 | 0 | 61 | 171 | 192 | 0.89 | $2 \times 10^{11}$ | $5 \times 10^{13}$ | PRESENT INVENTION EXAMPLE |
| 10 | 24 | 76 | 0 | 68 | 193 | 201 | 0.96 | $3 \times 10^{11}$ | $3 \times 10^{13}$ | PRESENT INVENTION EXAMPLE |
| 11 | 23 | 77 | 0 | 38 | 251 | 261 | 0.96 | $5 \times 10^{11}$ | $4 \times 10^{13}$ | PRESENT INVENTION EXAMPLE |
| 12 | 19 | 81 | 0 | 64 | 241 | 262 | 0.92 | $4 \times 10^{11}$ | $5 \times 10^{13}$ | PRESENT INVENTION EXAMPLE |
| 13 | 20 | 80 | 0 | 55 | 195 | 216 | 0.90 | $4 \times 10^{11}$ | $5 \times 10^{13}$ | PRESENT INVENTION EXAMPLE |
| 14 | 28 | 72 | 0 | 57 | 200 | 208 | 0.96 | $4 \times 10^{11}$ | $4 \times 10^{13}$ | PRESENT INVENTION EXAMPLE |
| 15 | 35 | 65 | 0 | 85 | 200 | 222 | 0.90 | $5 \times 10^{11}$ | $5 \times 10^{13}$ | PRESENT INVENTION EXAMPLE |
| 16 | 24 | 76 | 0 | 80 | 231 | 243 | 0.95 | $4 \times 10^{11}$ | $3 \times 10^{13}$ | PRESENT INVENTION EXAMPLE |
| 17 | 40 | 60 | 0 | 74 | 179 | 187 | 0.96 | $3 \times 10^{11}$ | $2 \times 10^{13}$ | PRESENT INVENTION EXAMPLE |
| 18 | 41 | 59 | 0 | 72 | 178 | 186 | 0.96 | $4 \times 10^{11}$ | $4 \times 10^{13}$ | PRESENT INVENTION EXAMPLE |
| 19 | 55 | 45 | 0 | 79 | 154 | 168 | 0.92 | $4 \times 10^{11}$ | $5 \times 10^{13}$ | PRESENT INVENTION EXAMPLE |
| 20 | 20 | 80 | 0 | 50 | 203 | 214 | 0.95 | $4 \times 10^{11}$ | $4 \times 10^{13}$ | PRESENT INVENTION EXAMPLE |
| 21 | 22 | 78 | 0 | 67 | 194 | 214 | 0.91 | $3 \times 10^{11}$ | $4 \times 10^{13}$ | PRESENT INVENTION EXAMPLE |

TABLE 8

| TEST No. | FERRITE AREA RATIO (%) | BAINITE AREA RATIO (%) | BALANCE STRUCTURE (%) | PROPORTION OF CRYSTAL GRAINS EACH HAVING INTRAGRANULAR MISORIENTATION OF 5 TO 14° (%) | SURFACE LAYER HARDNESS Hvs | CENTER HARDNESS Hvc | HARDNESS RATIO | PRECIPITATE DENSITY (PRECIPITATE/mm$^2$) | DISLOCATION DENSITY (/m$^2$) | NOTE |
|---|---|---|---|---|---|---|---|---|---|---|
| 22 | 0 | 65 | 15% PEARLITE, BALANCE MARTENSITE | 19 | 252 | 271 | 0.93 | $5 \times 10^{11}$ | $3 \times 10^{13}$ | COMPARATIVE EXAMPLE |
| 23 | 98 | 0 | 0 | 5 | 184 | 200 | 0.92 | $4 \times 10^{11}$ | $5 \times 10^{13}$ | COMPARATIVE EXAMPLE |
| 24 | 6 | 67 | 0 | 12 | 289 | 311 | 0.93 | $3 \times 10^{11}$ | $3 \times 10^{13}$ | COMPARATIVE EXAMPLE |
| 25 | 80 | 20 | BALANCE MARTENSITE | 21 | 125 | 140 | 0.89 | $5 \times 10^{11}$ | $5 \times 10^{13}$ | COMPARATIVE EXAMPLE |
| 26 | | | | CRACK OCCURRED DURING ROLLING | | | | | | COMPARATIVE EXAMPLE |
| 27 | 88 | 12 | 0 | 8 | 276 | 310 | 0.89 | $2 \times 10^{11}$ | $3 \times 10^{13}$ | COMPARATIVE EXAMPLE |
| 28 | 75 | 25 | 0 | 17 | 138 | 180 | 0.77 | $2 \times 10^{9}$ | $3 \times 10^{13}$ | COMPARATIVE EXAMPLE |
| 29 | 52 | 48 | 0 | 4 | 177 | 224 | 0.79 | $3 \times 10^{11}$ | $5 \times 10^{13}$ | COMPARATIVE EXAMPLE |
| 30 | 40 | 60 | 0 | 17 | 236 | 251 | 0.94 | $4 \times 10^{11}$ | $3 \times 10^{13}$ | COMPARATIVE EXAMPLE |
| 31 | 38 | 62 | 0 | 15 | 228 | 256 | 0.89 | $2 \times 10^{11}$ | $3 \times 10^{13}$ | COMPARATIVE EXAMPLE |
| 32 | 35 | 65 | 0 | 5 | 232 | 244 | 0.95 | $5 \times 10^{11}$ | $3 \times 10^{13}$ | COMPARATIVE EXAMPLE |
| 33 | 75 | 25 | 0 | 15 | 180 | 240 | 0.75 | $3 \times 10^{11}$ | $2 \times 10^{13}$ | COMPARATIVE EXAMPLE |
| 34 | 3 | 97 | 0 | 5 | 247 | 257 | 0.96 | $4 \times 10^{11}$ | $4 \times 10^{13}$ | COMPARATIVE EXAMPLE |
| 35 | 78 | 22 | 0 | 15 | 158 | 202 | 0.78 | $4 \times 10^{11}$ | $5 \times 10^{13}$ | COMPARATIVE EXAMPLE |
| 36 | 2 | 98 | 0 | 15 | 208 | 229 | 0.91 | $5 \times 10^{11}$ | $3 \times 10^{13}$ | COMPARATIVE EXAMPLE |
| 37 | 82 | 18 | 0 | 11 | 181 | 232 | 0.78 | $4 \times 10^{11}$ | $3 \times 10^{13}$ | COMPARATIVE EXAMPLE |
| 38 | 69 | 31 | 0 | 10 | 200 | 210 | 0.95 | $2 \times 10^{11}$ | $4 \times 10^{13}$ | COMPARATIVE EXAMPLE |
| 39 | 43 | 57 | 0 | 12 | 216 | 232 | 0.93 | $3 \times 10^{11}$ | $5 \times 10^{13}$ | COMPARATIVE EXAMPLE |
| 40 | 78 | 22 | 0 | 10 | 162 | 208 | 0.78 | $7 \times 10^{9}$ | $5 \times 10^{13}$ | COMPARATIVE EXAMPLE |
| 41 | 32 | 68 | 0 | 50 | 166 | 216 | 0.77 | $5 \times 10^{9}$ | $3 \times 10^{13}$ | COMPARATIVE EXAMPLE |
| 42 | 32 | 68 | 0 | 60 | 175 | 216 | 0.81 | $2 \times 10^{11}$ | $5 \times 10^{13}$ | COMPARATIVE EXAMPLE |
| 43 | 32 | 68 | 0 | 62 | 171 | 216 | 0.79 | $4 \times 10^{9}$ | $2 \times 10^{14}$ | COMPARATIVE EXAMPLE |

TABLE 8-continued

| TEST No. | FERRITE AREA RATIO (%) | BAINITE AREA RATIO (%) | BALANCE STRUCTURE (%) | PROPORTION OF CRYSTAL GRAINS EACH HAVING INTRAGRANULAR MISORIENTATION OF 5 TO 14° (%) | SURFACE LAYER HARDNESS Hvs | CENTER HARDNESS Hvc | HARDNESS RATIO | PRECIPITATE DENSITY (PRECIPITATE/$mm^2$) | DISLOCATION DENSITY (/$m^2$) | NOTE |
|---|---|---|---|---|---|---|---|---|---|---|
| 44 | 32 | 68 | 0 | 53 | 175 | 216 | 0.81 | $8 \times 10^9$ | $4 \times 10^{14}$ | COMPARATIVE EXAMPLE |
| 45 | 32 | 68 | 0 | 55 | 168 | 216 | 0.78 | $8 \times 10^9$ | $5 \times 10^{14}$ | COMPARATIVE EXAMPLE |
| 46 | 32 | 68 | 0 | 47 | 180 | 216 | 0.83 | $8 \times 10^9$ | $4 \times 10^{13}$ | COMPARATIVE EXAMPLE |

Next, in a tensile test, a yield strength and a tensile strength were obtained, and by a saddle-type stretch-flange test, a limit form height was obtained. Further, the product of the tensile strength (MPa) and the limit form height (mm) was used as an index of the stretch flangeability to perform evaluation, and the case of the product being 19500 mm·MPa or more was judged to be excellent in stretch flangeability.

As for the tensile test, a JIS No. 5 tensile test piece was collected from a direction right angle to the rolling direction, and this test piece was used to perform the test according to JISZ2241. The acceptance range of elongation depending on the strength level of the tensile strength was determined by Expression (6) below, and the elongation (EL) was evaluated. Concretely, the acceptance range of the elongation was set to a range of equal to or more than the value of the right side of Expression (6) below in consideration of the balance with the tensile strength.

$$\text{Elongation [\%]} \geq 30 - 0.02 \times \text{tensile strength [MPa]} \quad (6)$$

Further, the saddle-type stretch-flange test was performed by using a saddle-type formed product in which a radius of curvature R of a corner portion is set to 60 mm and an opening angle θ of the corner portion is set to 120° and setting a clearance at the time of punching the corner portion to 11%. Further, the limit form height was set to a limit form height with no existence of cracks by visually observing whether or not a crack having a length of ⅓ or more of the sheet thickness exists after forming.

Regarding evaluation of the hardness, a MVK-E micro Vickers hardness tester manufactured by Akashi Seisakusho, Ltd. was used to measure the hardness of a cross section of the steel sheet. As the hardness of the surface layer of the steel sheet (HvS), the hardness at the position of 20 μm in depth from the surface to the inside was measured. Further, as the hardness of the center portion of the steel sheet (Hvc), the hardness at the position of ¼ inner side of the sheet thickness from the surface of the steel sheet was measured. At each of the positions, the hardness measurement was performed three times, and the average value of measured values was set to the hardness (Hvs, Hvc) (average value of n=3). Incidentally, an applied load was set to 50 gf.

The fatigue strength was measured by using a Schenck type plane bending fatigue testing machine in conformity with JIS-Z2275. The stress load during measurement was set at a speed of reversed stress testing of 30 Hz. Further, according to the above-described conditions, the fatigue strength was measured at a cycle of 107 by the Schenck type plane bending fatigue testing machine. Then, the fatigue strength at a cycle of 107 was divided by the tensile strength measured by the above-described tensile test to then calculate a fatigue strength ratio. The fatigue strength ratio of 0.45 or more was set as acceptance.

These results are illustrated in Table 9 and Table 10. Each underline in Table 10 indicates that a numerical value thereof is out of a desirable range.

TABLE 9

| TEST No. | YIELD STRENGTH (MPa) | TENSILE STRENGTH (MPa) | YIELD RATIO (—) | EL (%) | RIGHT SIDE OF EXPRESSION (6) | FATIGUE STRENGTH (MPa) | FATIGUE STRENGTH RATIO | INDEX OF STRETCH FLANGEABILITY (mm · MPa) | NOTE |
|---|---|---|---|---|---|---|---|---|---|
| 2 | 580 | 610 | 0.95 | 24.2 | 18 | 287 | 0.47 | 22533 | PRESENT INVENTION EXAMPLE |
| 3 | 755 | 810 | 0.93 | 18.2 | 14 | 389 | 0.48 | 21632 | PRESENT INVENTION EXAMPLE |
| 4 | 678 | 787 | 0.86 | 18.7 | 14 | 378 | 0.48 | 22157 | PRESENT INVENTION EXAMPLE |
| 5 | 518 | 604 | 0.86 | 24.4 | 18 | 278 | 0.46 | 20103 | PRESENT INVENTION EXAMPLE |
| 6 | 709 | 800 | 0.89 | 18.4 | 14 | 384 | 0.48 | 20419 | PRESENT INVENTION EXAMPLE |
| 7 | 616 | 719 | 0.86 | 20.5 | 16 | 345 | 0.48 | 21094 | PRESENT INVENTION EXAMPLE |
| 8 | 687 | 777 | 0.88 | 19.0 | 14 | 373 | 0.48 | 22222 | PRESENT INVENTION EXAMPLE |
| 9 | 577 | 617 | 0.94 | 23.9 | 18 | 284 | 0.46 | 22558 | PRESENT INVENTION EXAMPLE |
| 10 | 560 | 644 | 0.87 | 22.9 | 17 | 296 | 0.46 | 22048 | PRESENT INVENTION EXAMPLE |
| 11 | 765 | 836 | 0.91 | 17.6 | 13 | 401 | 0.48 | 20743 | PRESENT INVENTION EXAMPLE |
| 12 | 683 | 838 | 0.81 | 17.6 | 13 | 402 | 0.48 | 22383 | PRESENT INVENTION EXAMPLE |
| 13 | 654 | 693 | 0.94 | 21.3 | 16 | 326 | 0.47 | 21204 | PRESENT INVENTION EXAMPLE |
| 14 | 582 | 667 | 0.87 | 22.1 | 17 | 320 | 0.48 | 21915 | PRESENT INVENTION EXAMPLE |
| 15 | 575 | 713 | 0.81 | 20.7 | 16 | 349 | 0.49 | 22941 | PRESENT INVENTION EXAMPLE |
| 16 | 726 | 779 | 0.93 | 18.9 | 14 | 366 | 0.47 | 22536 | PRESENT INVENTION EXAMPLE |
| 17 | 531 | 599 | 0.89 | 24.6 | 18 | 276 | 0.46 | 22328 | PRESENT INVENTION EXAMPLE |
| 18 | 548 | 595 | 0.92 | 24.8 | 18 | 280 | 0.47 | 22755 | PRESENT INVENTION EXAMPLE |
| 19 | 474 | 537 | 0.88 | 27.4 | 19 | 247 | 0.46 | 22562 | PRESENT INVENTION EXAMPLE |
| 20 | 604 | 684 | 0.88 | 21.6 | 16 | 328 | 0.48 | 23181 | PRESENT INVENTION EXAMPLE |
| 21 | 606 | 684 | 0.89 | 21.6 | 16 | 322 | 0.47 | 25325 | PRESENT INVENTION EXAMPLE |

TABLE 10

| TEST No. | YIELD STRENGTH (MPa) | TENSILE STRENGTH (MPa) | YIELD RATIO (—) | EL (%) | RIGHT SIDE OF EXPRESSION (6) | FATIGUE STRENGTH (MPa) | FATIGUE STRENGTH RATIO | INDEX OF STRETCH FLANGEABILITY (mm · MPa) | NOTE |
|---|---|---|---|---|---|---|---|---|---|
| 22 | 683 | 868 | 0.79 | 17.0 | 13 | 408 | 0.47 | 17300 | COMPARATIVE EXAMPLE |
| 23 | 632 | 641 | 0.99 | 23.0 | 17 | 295 | 0.46 | 18030 | COMPARATIVE EXAMPLE |
| 24 | 883 | 997 | 0.89 | 14.8 | 10 | 488 | 0.49 | 11000 | COMPARATIVE EXAMPLE |
| 25 | 350 | 450 | 0.78 | 32.8 | 21 | 207 | 0.46 | 20350 | COMPARATIVE EXAMPLE |

TABLE 10-continued

| TEST No. | YIELD STRENGTH (MPa) | TENSILE STRENGTH (MPa) | YIELD RATIO (—) | EL (%) | RIGHT SIDE OF EXPRESSION (6) | FATIGUE STRENGTH (MPa) | FATIGUE STRENGTH RATIO | INDEX OF STRETCH FLANGEABILITY (mm · MPa) | NOTE |
|---|---|---|---|---|---|---|---|---|---|
| 26 | | | CRACK OCCURRED DURING ROLLING | | | | | | COMPARATIVE EXAMPLE |
| 27 | 901 | 993 | 0.91 | 14.9 | 10 | 467 | 0.47 | 8000 | COMPARATIVE EXAMPLE |
| 28 | 490 | 576 | 0.75 | 25.6 | 18 | 219 | 0.38 | 17535 | COMPARATIVE EXAMPLE |
| 29 | 663 | 719 | 0.92 | 20.5 | 16 | 295 | 0.41 | 17545 | COMPARATIVE EXAMPLE |
| 30 | 756 | 804 | 0.94 | 18.4 | 14 | 386 | 0.48 | 18400 | COMPARATIVE EXAMPLE |
| 31 | 769 | 819 | 0.94 | 18.0 | 14 | 393 | 0.48 | 18550 | COMPARATIVE EXAMPLE |
| 32 | 749 | 783 | 0.96 | 18.8 | 14 | 384 | 0.49 | 18880 | COMPARATIVE EXAMPLE |
| 33 | 759 | 768 | 0.99 | 19.2 | 15 | 307 | 0.40 | 18147 | COMPARATIVE EXAMPLE |
| 34 | 769 | 824 | 0.93 | 17.9 | 14 | 379 | 0.46 | 15400 | COMPARATIVE EXAMPLE |
| 35 | 565 | 648 | 0.87 | 22.8 | 17 | 266 | 0.41 | 17631 | COMPARATIVE EXAMPLE |
| 36 | 661 | 733 | 0.90 | 20.1 | 15 | 359 | 0.49 | 16390 | COMPARATIVE EXAMPLE |
| 37 | 713 | 745 | 0.96 | 19.8 | 15 | 298 | 0.40 | 19504 | COMPARATIVE EXAMPLE |
| 38 | 568 | 674 | 0.84 | 21.9 | 17 | 310 | 0.46 | 17560 | COMPARATIVE EXAMPLE |
| 39 | 603 | 744 | 0.81 | 19.8 | 15 | 342 | 0.46 | 18980 | COMPARATIVE EXAMPLE |
| 40 | 568 | 667 | 0.85 | 22.1 | 17 | 267 | 0.40 | 17650 | COMPARATIVE EXAMPLE |
| 41 | 652 | 692 | 0.94 | 21.3 | 16 | 304 | 0.44 | 19560 | COMPARATIVE EXAMPLE |
| 42 | 654 | 693 | 0.94 | 14.0 | 16 | 284 | 0.41 | 19580 | COMPARATIVE EXAMPLE |
| 43 | 650 | 693 | 0.76 | 21.3 | 16 | 305 | 0.44 | 20000 | COMPARATIVE EXAMPLE |
| 44 | 654 | 691 | 0.75 | 21.4 | 16 | 297 | 0.43 | 19400 | COMPARATIVE EXAMPLE |
| 45 | 653 | 691 | 0.95 | 21.4 | 16 | 283 | 0.41 | 18600 | COMPARATIVE EXAMPLE |
| 46 | 653 | 693 | 0.94 | 21.3 | 16 | 305 | 0.44 | 19560 | COMPARATIVE EXAMPLE |

In the present invention examples (Test No. 1 to 21), the tensile strength of 480 MPa or more, the yield ratio of 0.80 or more (ratio of the tensile strength and the yield strength), the product of the tensile strength and the limit form height in the saddle-type stretch-flange test of 19500 mm·MPa or more, and the fatigue strength ratio of 0.45 or more were obtained.

Test No. 22 to 27 each are a comparative example in which the chemical composition is out of the range of the present invention. In Test No. 22 to 24, the index of the stretch flangeability did not satisfy the target value. In Test No. 25, the total content of Ti and Nb and the C content were small, and thus the index of the stretch flangeability and the tensile strength did not satisfy the target values. In Test No. 26, the total content of Ti and Nb was large, and thus the workability deteriorated and cracks occurred during rolling. In Test No. 27, the total content of Ti and Nb was large, and thus the index of the stretch flangeability did not satisfy the target value.

Test No. 28 to 46 each are a comparative example in which the manufacturing conditions were out of a desirable range, and thus one or more of the structures observed by an optical microscope, the proportion of the crystal grains each having an intragranular misorientation of 5 to 14°, the precipitate density, and the hardness ratio did not satisfy the range of the present invention. In Test No. 28 to 40, the proportion of the crystal grains each having an intragranular misorientation of 5 to 14° was small, and thus the index of the stretch flangeability and the fatigue strength ratio did not satisfy the target values. In Test No. 41 and 43 to 46, the precipitate density was small or the hardness ratio was low, and thus the fatigue strength ratio did not satisfy the target value.

INDUSTRIAL APPLICABILITY

According to the present invention, it is possible to provide a high-strength steel sheet that is applicable to members that require strict stretch flangeability while having high strength and has excellent stretch flangeability and fatigue property. This steel sheet contributes to improvement of fuel efficiency and so on of automobiles, and thus has high industrial applicability.

The invention claimed is:

1. A steel sheet, comprising:

a chemical composition represented by, in mass %,

C: 0.008 to 0.150%,

Si: 0.01 to 1.70%,

Mn: 0.60 to 2.50%,

Al: 0.015 to 0.60%,

Ti: 0 to 0.200%,

Nb: 0 to 0.200%,

Ti+Nb: 0.015 to 0.200%,

Cr: 0 to 1.0%,

B: 0 to 0.10%,

Mo: 0 to 1.0%,

Cu: 0 to 2.0%,

Ni: 0 to 2.0%,

Mg: 0 to 0.05%,

REM: 0 to 0.05%,

Ca: 0 to 0.05%,

Zr: 0 to 0.05%,

P: 0.05% or less,

S: 0.0200% or less,

N: 0.0060% or less, and balance: Fe and impurities; and a structure represented by, by area ratio, ferrite: 5 to 60%, and bainite: 40 to 85%, wherein a region that is surrounded by a grain boundary having a misorientation of 150 or more and having a circle-equivalent diameter of 0.3 μm or more is defined as a crystal grain, and the proportion of crystal grains each having an intragranular misorientation of 5 to 14° to all crystal grains is 20 to 100% by area ratio, a precipitate density of Ti(C,N) and Nb(C,N) each having a circle-equivalent diameter of 10 nm or less is $10^{10}$ precipitates/$mm^3$ or more, and a ratio (Hvs/Hvc) of a hardness at 20 μm in depth from a surface (Hvs) to a hardness of the center of a sheet thickness (Hvc) is 0.85 or more.

2. The steel sheet according to claim 1, wherein
an average dislocation density is $1\times10^{14}$ $m^{-2}$ or less.

3. The steel sheet according to claim 1, wherein
a tensile strength is 480 MPa or more,
a ratio of the tensile strength and a yield strength is 0.80 or more,
a product of the tensile strength and a limit form height in a saddle-type stretch-flange test is 19500 mm·MPa or more, and
a fatigue strength ratio is 0.45 or more.

4. The steel sheet according to claim 1, wherein
the chemical composition contains, in mass %, one type or more selected from the group consisting of
Cr: 0.05 to 1.0%, and
B: 0.0005 to 0.10%.

5. The steel sheet according to claim 1, wherein
the chemical composition contains, in mass %, one type or more selected from the group consisting of
Mo: 0.01 to 1.0%,
Cu: 0.01 to 2.0%, and
Ni: 0.01% to 2.0%.

6. The steel sheet according to claim 1, wherein
the chemical composition contains, in mass %, one type or more selected from the group consisting of
Ca: 0.0001 to 0.05%,
Mg: 0.0001 to 0.05%,
Zr: 0.0001 to 0.05%, and
REM: 0.0001 to 0.05%.

7. The steel sheet according to claim 1, wherein
a plating layer is formed on a surface of the steel sheet.

8. The steel sheet according to claim 7, wherein
the plating layer is a hot-dip galvanizing layer.

9. The steel sheet according to claim 8, wherein
the plating layer is an alloyed hot-dip galvanizing layer.

* * * * *